US006626472B1

(12) United States Patent
Berg

(10) Patent No.: US 6,626,472 B1
(45) Date of Patent: Sep. 30, 2003

(54) LOAD FLOOR LATCH

(75) Inventor: Gert Berg, Cheltenham (GB)

(73) Assignee: Southco, Inc., Concordville, PA (US)

( * ) Notice: Subject to any disclaimer, the term of this patent is extended or adjusted under 35 U.S.C. 154(b) by 0 days.

(21) Appl. No.: 09/557,678

(22) Filed: Apr. 25, 2000

Related U.S. Application Data

(63) Continuation-in-part of application No. 09/510,417, filed on Feb. 22, 2000, now abandoned, which is a continuation-in-part of application No. 09/405,526, filed on Sep. 23, 1999, now abandoned, which is a continuation-in-part of application No. 09/255,586, filed on Feb. 22, 1999, now abandoned.

(51) Int. Cl.[7] ..... E05B 3/00

(52) U.S. Cl. ..... 292/336.3; 292/DIG. 31; 70/208

(58) Field of Search ..... 70/208, 201, 210; 292/DIG. 31, 37, 38, 63, 336.3

(56) References Cited

U.S. PATENT DOCUMENTS

| | | | | |
|---|---|---|---|---|
| 2,987,908 | A | 6/1961 | Pelcin | 292/DIG. 31 |
| 3,782,141 | A | 1/1974 | Doerrfeld | 70/146 |
| 4,186,952 | A | 2/1980 | Glass | 292/202 |
| 4,322,958 | A | 4/1982 | Eigemeier | 70/107 |
| 4,438,964 | A | 3/1984 | Peters | 292/216 |
| 4,492,396 | A | 1/1985 | Luke et al. | 292/DIG. 31 |
| 4,542,924 | A | 9/1985 | Brown et al. | 292/87 |
| 4,552,001 | A | 11/1985 | Roop | 70/208 |
| 4,638,649 | A | 1/1987 | Chao | 292/DIG. 31 |
| 4,969,916 | A | 11/1990 | Weinerman et al. | 70/208 |
| 5,297,400 | A | 3/1994 | Benton et al. | 70/1.5 |
| 5,321,962 | A | 6/1994 | Ferchau et al. | 70/208 |
| 5,878,608 | A | 3/1999 | Alyanakian | 70/208 |

*Primary Examiner*—Suzanne Dino Barrett
(74) *Attorney, Agent, or Firm*—Paul & Paul

(57) ABSTRACT

A pawl latch for securing a first member to a second member, such as, for example, a closure panel to a frame or enclosure compartment, the latch including a housing, a handle pivotally carried on the housing, an actuator, and a spring biased pawl, the handle having a tab which engages with the actuator to retract the pawl from engagement with a keeper member or surface to open the latch, the actuator being connected to the pawl through a plurality of slots, disposed in the floor of the housing. A locking mechanism is also provided for securing the latch from unauthorized opening, the locking mechanism having a locking element which holds the actuator against movement and prevents the retraction of the pawl.

56 Claims, 28 Drawing Sheets

FIG. 7
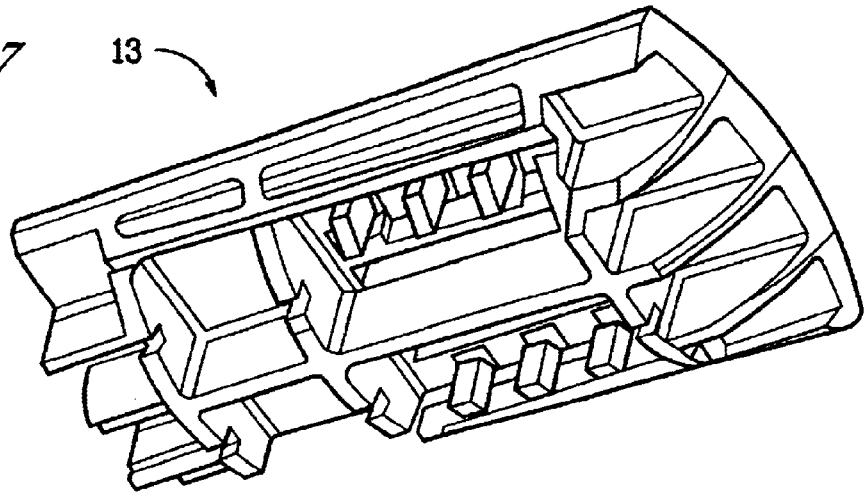
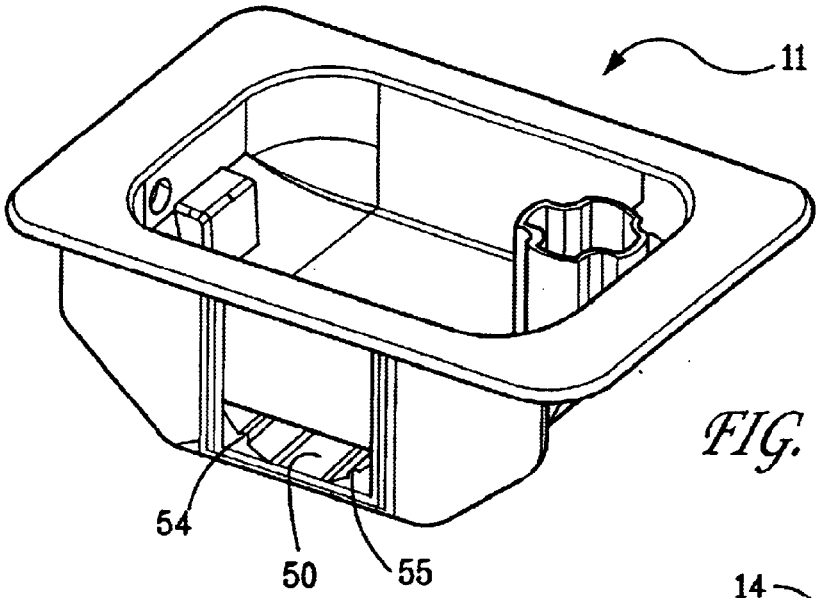
FIG. 8
FIG. 9
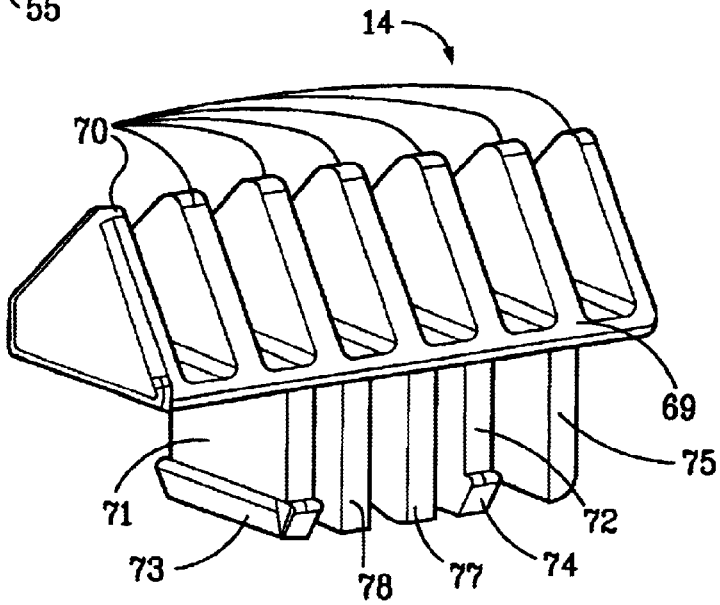

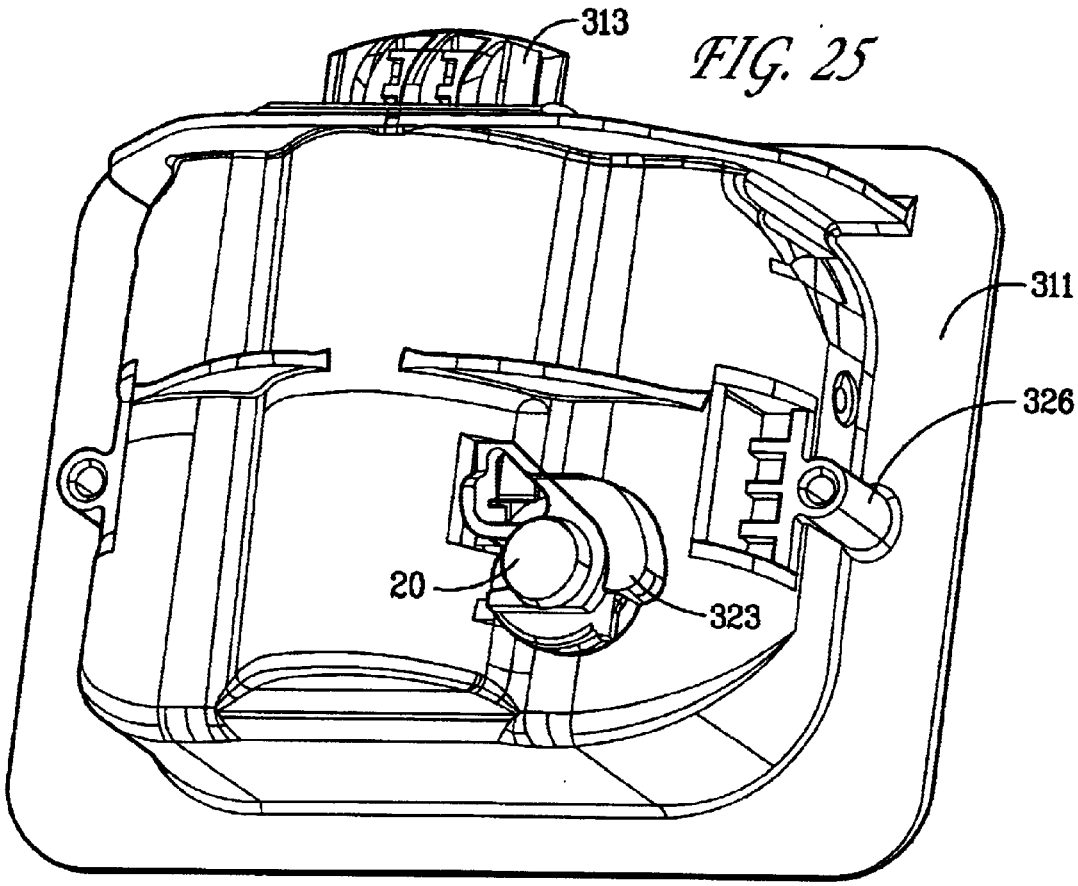
FIG. 25
FIG. 26
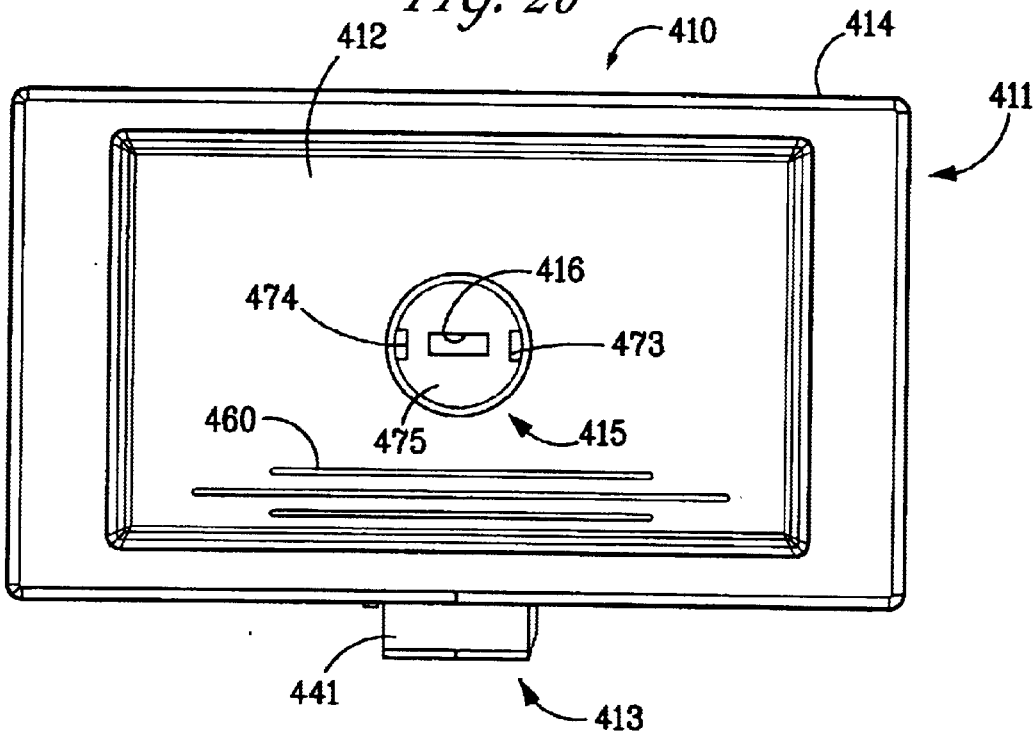

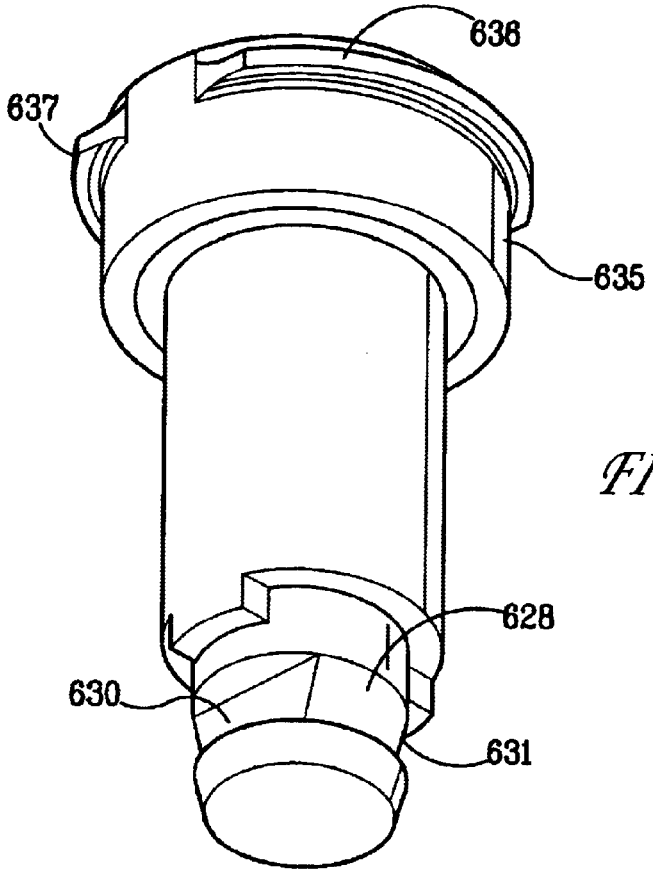
FIG. 45
FIG. 46
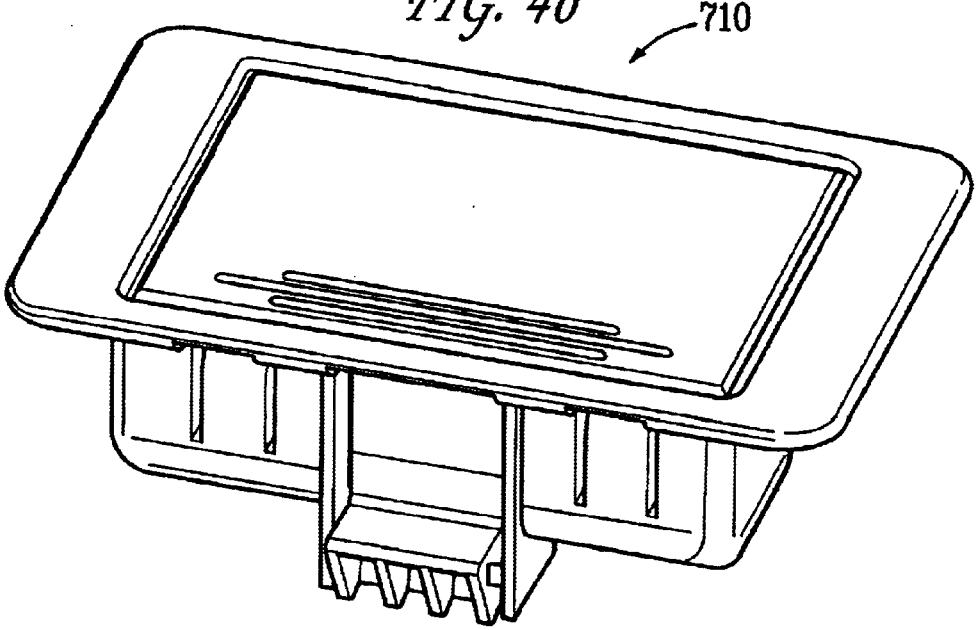

LOAD FLOOR LATCH

CROSS-REFERENCE TO RELATED APPLICATIONS

This is a continuation-in-part of U.S. application Ser. No. 09/510,417, filed on Feb. 22, 2000 now abandoned, which is a continuation-in-part of U.S. application Ser. No. 09/405,526, filed on Sep. 23, 1999, now abandonded which is a continuation-in-part of U.S. application Ser. No. 09/255,586, filed on Feb. 22, 1999 (now abandoned), the complete disclosures of which are herein incorporated by reference.

BACKGROUND OF THE INVENTION

1. Field of the Invention

The present invention relates to the field of latches and more particularly to slam-action latches in which a handle is lifted to release the latch pawl from engagement with a keeper.

2. Brief Description of the Related Art

Slam-action latches are known in the art and are employed in a number of applications for securing one or more panels together. Generally, latches coming within this category operate by forcing a pawl into engagement with a keeper. For example, where a first panel member has a pawl mounted on it and a second panel member, such as, for example, a cabinet, has a keeper mounted thereon, slamming shut the first panel member against the second panel member can secure the panels with the latch.

In many instances, separately provided spring members are utilized to bias the pawl into engagement with a keeper member. Thus, when a panel to which the latch is installed is closed, the pawl engages a keeper. The utilization of a separately provided spring member often increases the cost of the latch and the time for assembly or construction of the latch. In some cases, complex mechanisms are required to maintain spring members and align them with a pawl so the pawl can be regulated to operate and engage and disengage a keeper.

A need exists for a latch which can provide an improvement over the prior art in that it will be less costly to produce and less time-consuming to assemble, as well as providing slam-action latching ability when the latch is detached from a keeper but in the closed position.

A further need exists for a latch which can be locked, and slammed shut to close and lock the latch, when its pawl is not engaged with a keeper.

In addition, load floor latches are commonly used in the automotive industry. Often, these latches are employed to secure the contents of a compartment in a cargo area. For example, load floor latches find use for securing a floor panel, such as the panel which regulates access to vehicle items, such as spare tires, tools, jacks, batteries, and the like. In many case, the floor panel is provided on the floor of a vehicle passenger or cargo compartment. The latch therefore must be durable, and it is desirable that the latch withstand substantial force loads, such as those of the type generally encountered by bumps, rough terrain, and especially vehicular accidents, such as crashes, or rollover situations. It is important that compartment contents remain secured in the event of a vehicle crash or rollover. This is especially more important where the cargo compartment is located in the same general area as the vehicle operator, or other passengers. For example, in station wagon type vehicles, the cargo space for passengers and items of cargo is the same. Thus, in this type of vehicle, there is great danger to be encountered should a rollover of the vehicle occur and the latch become unsecured. If this were to happen, the compartment contents would spill out into the passenger compartment, thereby placing the vehicle operator in danger. A need exists for a load floor latch which has improved abilities to withstand a rollover, and facilitate latching of a panel, even under high stress conditions. It is also important that the latch, in addition to being durable be easy to construct and install.

SUMMARY OF THE INVENTION

The present invention provides a novel slam latch having a handle, a housing and a pawl member which is disposed to engage a keeper member to secure a first member, such as a door or floor panel, to a second member, such as a frame or floor. Preferably, the latch can be installed on a closure panel and the keeper member on another panel or frame. The latch, for example, may be installed on a vehicle floor panel and a keeper can be installed on a corresponding frame.

The latch handle, upon being actuated, by lifting, operates to retract the pawl from engagement with a keeper member. Preferably, an actuator is provided which extends through the housing and connects with the pawl. The handle, by contacting the actuator withdraws the pawl member out from engagement with the keeper to release the latch and permit the closure panel to be opened. The pawl member is preferably spring biased and is retracted inwardly, within the housing. The pawl member is slidably carried in the housing and extends therefrom. The handle is pivotally connected to the housing and pivots relative thereto.

A locking mechanism preferably can be provided for securing the actuator against movement to prevent unauthorized actuation. The locking mechanism can be applied to allow the latch to be locked to prevent the pawl from being released from a keeper member.

The latch further has an improved stabilizing mechanism which facilitates retention of the latch in a latching position during vehicle crashes and rollovers.

An object of the present invention is to provide a novel latch which can secure one or more members together, such as panels or the like, for selective release by actuating a handle of the latch.

Another object of the present invention is to accomplish the above objects by providing a spring-biased latch which can be closed by slam-action.

Another object of the present invention is to provide a novel latch which can be closed by slam-action, even when the latch handle is in the closed position, and when the latch is not connected to a keeper.

Another object of the present invention is to provide a latch which can be Used in connection with panels of vehicles to regulate access to and from an area or compartment, such as, for example, a floor panel and a floor storage compartment.

Another object of the present invention is to provide a novel latch having a pawl member which is slidably guided for movement within a housing.

Another object of the present invention is to provide a locking mechanism which can secure the latch against unauthorized opening.

Another object of the present invention is to provide resistance when the pawl member is being opened or closed with the handle to bias the pawl to an engaging position.

Another object of the present invention is to provide a latch which has improved retention characteristics under stress forces, such as those experienced by vehicle rollovers and crashes.

These and other objects of the invention will become apparent upon a reading of the following detailed description of the invention with reference to the drawings, and the appended claims.

BRIEF DESCRIPTION OF THE DRAWING FIGURES

FIG. 7 is a perspective, separate view of the pawl member of the latch of FIG. 1, as viewed from the bottom, front side thereof.

FIG. 8 is a perspective, separate view of the housing of the latch of FIG. 1, as viewed from the top, right front thereof.

FIG. 9 is a perspective, separate view of the-actuator of the latch of FIG. 1.

FIG. 25 is bottom perspective view,of the latch assembly of FIGS. 22 and 23, shown in the locked position.

FIG. 26 is a top plan view of a fourth embodiment of a latch according to the present invention.

FIG. 45 is a side parallel perspective view of the lock plug shown with the embodiment of the latch of FIG. 37.

FIG. 46 is a front perspective view of a version of the latch of FIG. 37 that lacks a lockplug.

DETAILED DESCRIPTION OF THE PREFERRED EMBODIMENTS

Figure 1:
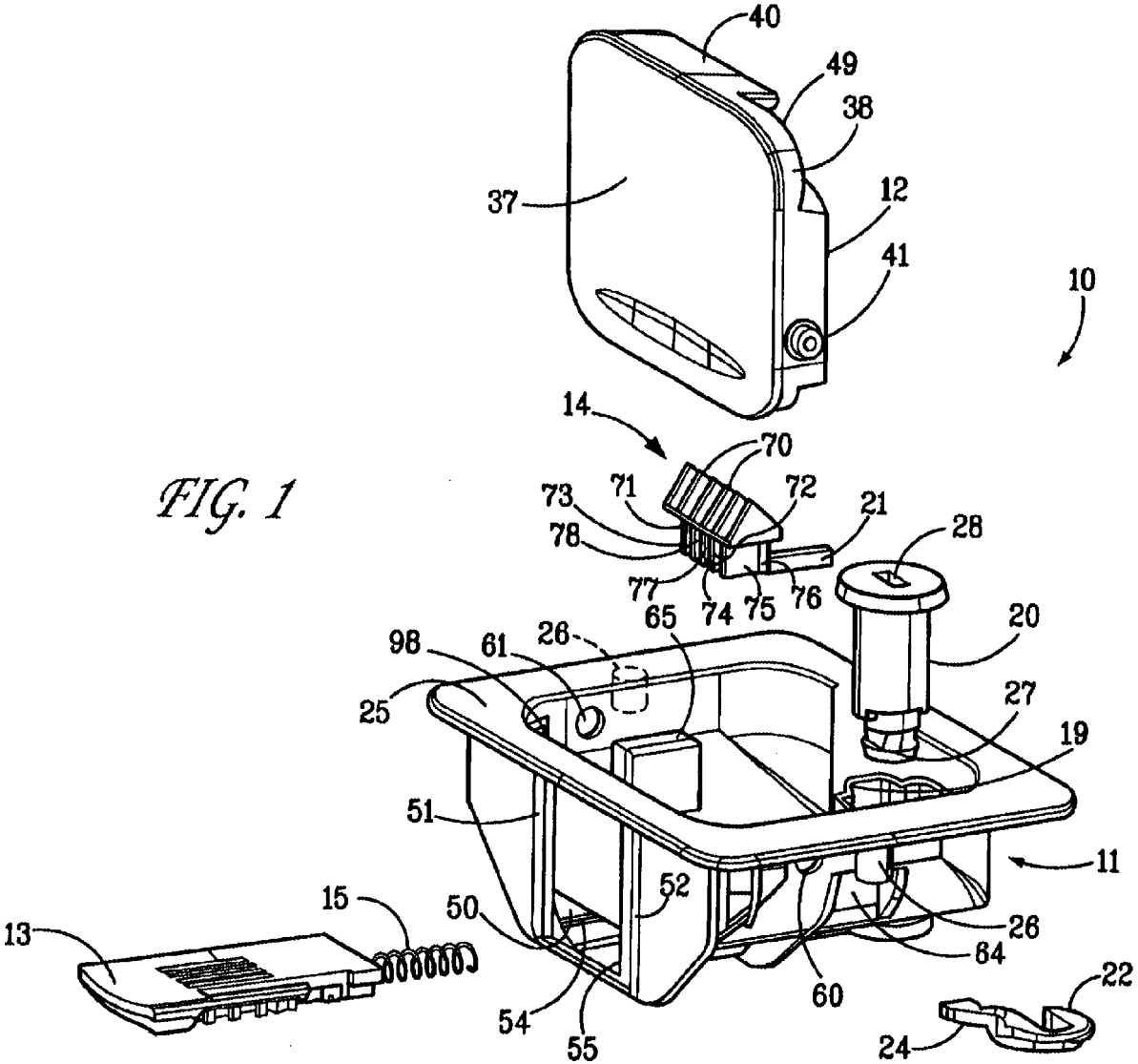
FIG. 1 is an exploded perspective view of a first embodiment of a latch according to the present invention.

Reference being made to FIG. 1, where a first alternate embodiment of a latch 10 according to the present invention is shown comprising a latch body or housing 11, a handle 12, a pawl member 13, and an actuator 14. Biasing means for biasing the pawl member 13 toward a latching position is shown comprising a spring 15.

The housing 11 has an upper flange 25 which defines the perimeter of the latch 10. Mounting means is provided on the housing 11, and preferably, for example, can comprise posts, such as those 26, which, for example, can have a bore with threads for receiving a matingly threaded bolt (not shown) for attachment of the latch 10 to a panel member (not shown). It will be understood that any suitable mounting members, such as, rivets, screws, pins, barbs and the like can be used to secure the housing 11 to a panel. Preferably, the latch, 10 can be installed on a floor panel of a vehicle to regulate access to and from a compartment.

Locking means is also provided to lock the latch 10 against unauthorized opening. The locking means is shown comprising a lock plug 20 which has a key slot 28 therein. Preferably, the housing 11 has a socket 19 in which the lock plug 20 is installed. The locking means further includes a locking element 21, and retaining means for retaining the lock plug 20 on the housing 11. The retaining means is shown comprising a retaining member 22 which is disposed on a connecting end 27 of the lockplug 20 located on the lockplug end opposite of the key slot 28 end. Preferably, the retaining member 22 comprises a spring member and is flexible.

Figure 2:
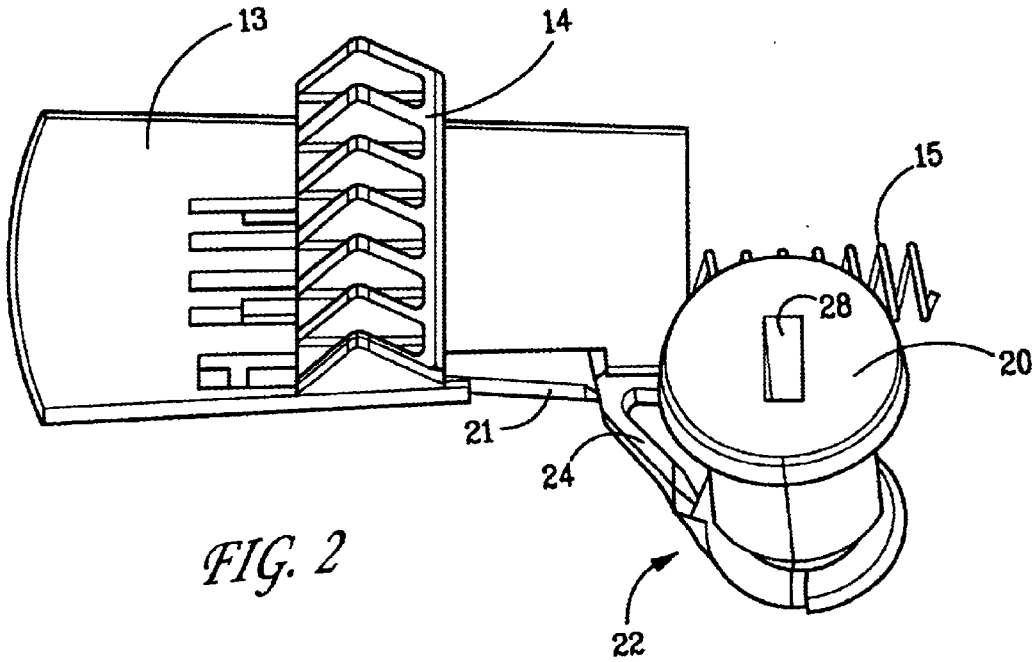
FIG. 2 is a perspective, separate view of the pawl, actuator, locking element, lock plug and retainer of the latch of FIG. 1, shown in the locked condition.
Figure 3:
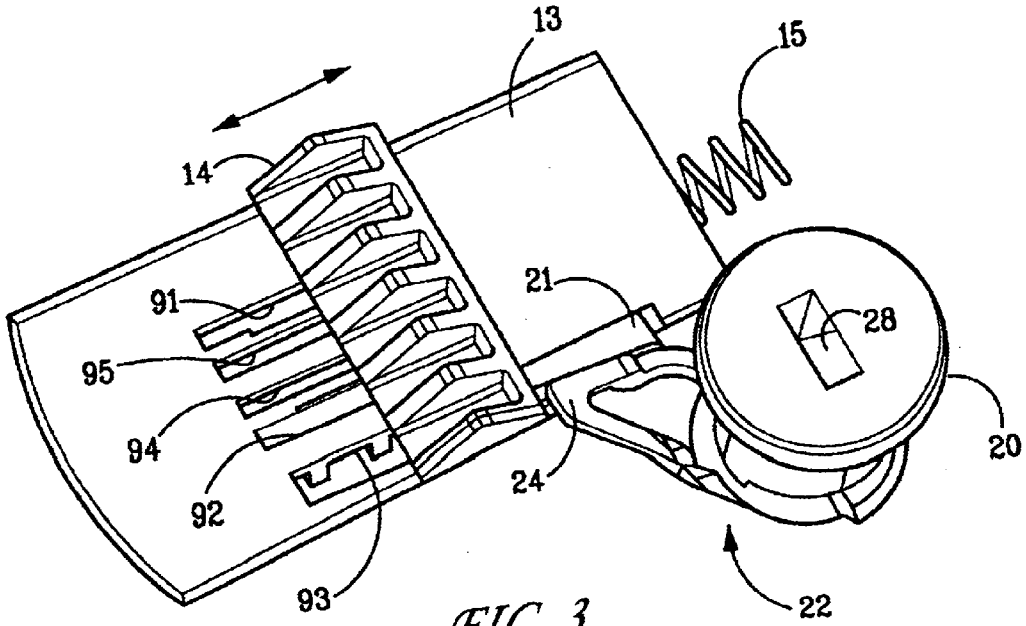
FIG. 3 is a perspective, separate view of the pawl, actuator, locking element, lock plug and retainer of the latch of FIG. 1, shown with the lock plug and retainer in the locked condition, with the pawl in a partially returned position.
Figure 4:
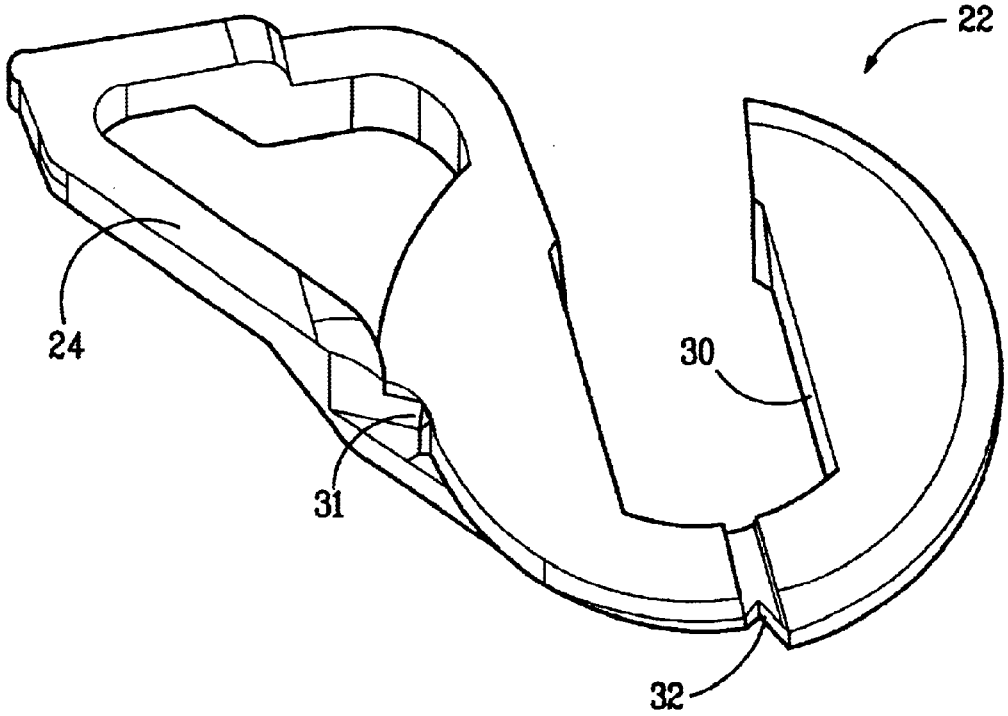
FIG. 4 is a perspective, separate view of a retaining member of the latch of FIG. 1.

The retaining element 22 secures the lock plug 20 and further is provided to selectively engage the locking element 21, as shown best in FIGS. 2 and 3, to lock the actuator 14 from movement and thereby maintain the pawl member 13 in a latched position. Referring to FIG. 4, the retaining member 22 has an arm 24 which extends outwardly therefrom for engagement with the locking element 21 (FIGS. 2 and 3). FIGS. 2 and 3 show the retaining member 22 installed on the lock plug-connecting end 27. As shown in FIG. 4, the retaining member 22 has an assembly slot 30 for facilitating snap-fit installation onto the lock plug 20. Detents 31, 32 are provided on the retaining member 22 for indicating the stop positions of the retaining member 22 when the lock plug is rotated with a key (not shown). The retaining member 22 is configured to be rotated by the lock plug 20 with the operation of a key (not shown) inserted and rotated in the key slot. 28.

Figure 5:
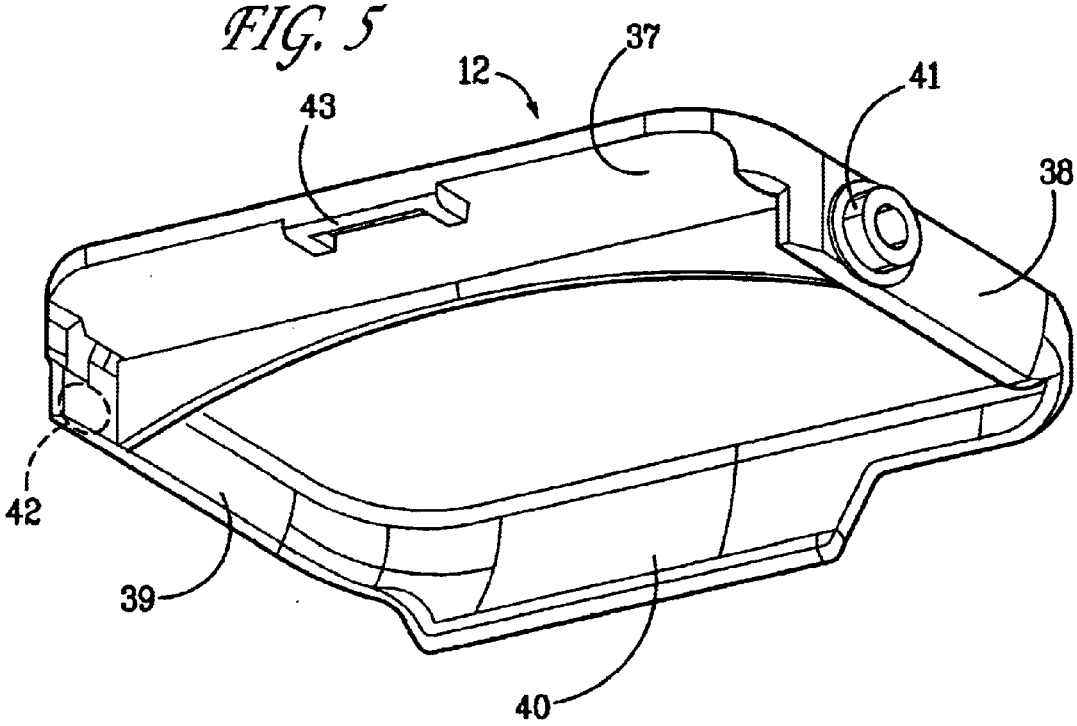
FIG. 5, is a perspective, separate view of the handle of the latch of FIG. 1.

Referring to FIG. 5, the handle 12 is shown in a separate view having a body 37 with a lifting portion 40, a pair of flanges 38, 39 on opposite sides of the handle 12, and mountings means for mounting the handle 12 to the housing 11, the mounting means comprising a pair of pivot bosses 41, 42 disposed on the flanges 38, 39, respectively. Contact means for contacting the actuator 14 is provided on the front of the handle 12 opposite the lifting portion 40. The contact means is shown comprising a tab 43 disposed on the handle body 37. The handle 12 further has a recess 49 provided for accommodating the lock plug 20, by permitting the top of the lock plug 20 to reside in the recess. 49 when the handle 12 is closed.

Figure 6:
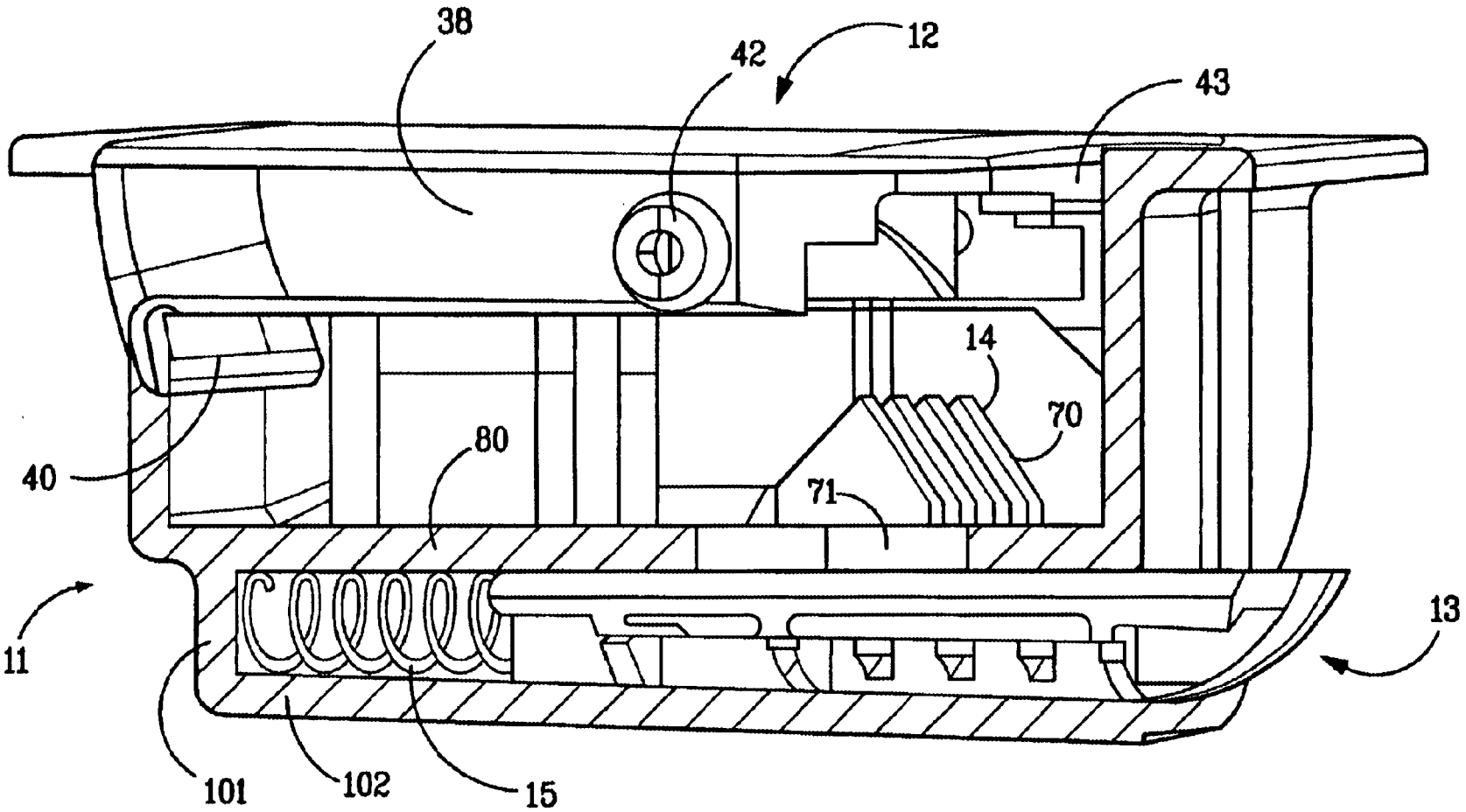
FIG. 6 is a left side, perspective view of the latch of FIG. 1, illustrated with the housing shown in sectional view.

Reference now being made to FIG. 6, the tab 43 is provided to engage with the front of the actuator 14, when the handle 12 is pivoted by lifting. The actuator 14 is a separate piece from the handle 12 and moves linearly in a direction parallel to the direction of the movement of the pawl member 13, in response to the pivotal movement of the handle 12. This lifting of the handle 12 draws the actuator 14 rearwardly within the housing 11 and through its engagement with the pawl 13, the actuator 14 retracts the pawl member 13 inwardly toward the housing 11. As shown in FIG. 1, a slot 50 is disposed in the front wall 49 of the housing 11 for receiving the pawl member 13 therein. The slot 50, preferably, is matingly configured to accommodate the pawl 13 and facilitate the movement of the pawl member 13 therein.

The housing slot 50 preferably can be provided with strengthening ribs 51, 52 disposed on opposite sides of the slot 50. The slot 50 is shown having a pair of tracks 54, 55 which are provided for mating association with the pawl 13. The pawl member 13, as shown in FIG. 7, has surfaces 57, 58 which facilitate siding of the pawl 13 along the tracks 54, 55 of the housing slot 50.

As shown in FIG. 1, the housing 11 has a pair of apertures 60, 61 each being disposed on opposite sides thereof. The pivot bosses 41, 42 of the handle 12 are carried in the pivot apertures 60, 61, respectively to pivotally maintain the handle 12 on the housing 11. Referring to FIGS. 1 and 5, the handle 12 has side flanges 38, 39 which facilitate alignment of the handle 12 relative to the housing 11. The housing 11 is provided with a first side ledge 64 and a second side ledge 65 disposed on each side thereof The first side ledge 64 provides a seat for the handle side flange 38 when the handle 12 is in its closed (FIG. 1) position. Similarly, the second side ledge 65 provides a seat for the second flange 39 on the opposite handle side. Preferably, the first and second ledges 64, 65 are positioned at a height sufficient to raise the handle 12 slightly off of the top of the lock plug 20. Alternately, the lock plug 20 can be utilized to further stabilize the latch handle 12 by providing an additional seat on which the handle 12 may rest. This is accomplished by arranging the flanges and heights of the first and second side ledges to correspond to the height of the lock plug 20.

Referring to FIG. 9, the actuator 14 is shown having handle engaging means for engaging with the handle 12. The handle engaging means is shown comprising a plurality of contact ribs 70 which are angled to maximize the contact with the handle tab portion 43 when the handle 12 is pivoted to engage the actuator 14. The contact ribs 70 are shown supported on a shelf or base. 69 of the actuator. The actuator 14 further has connecting means for connecting with the pawl member 13 to retract and release the pawl 13. The connecting means is shown comprising snap legs 71, 72 which extend downwardly from the actuator shelf or base 69 and are provided with a tapered flange portions 73, 74, respectively, which are shown provided on three, sides of each leg 71, 72. Stop means is provided for stopping the locking element 21. The stop means is shown comprising a stop leg member 75 extending downwardly from the shelf or base 69 of the actuator 14. Preferably, the stop leg 75 is provided on the outer end of the actuator 14 to facilitate interaction with the locking element 21. Referring to FIG. 1, the actuator stop leg 75 is provided with a widened portion, such as the head 76, disposed facing and in a position for engaging the locking element 21. The actuator 14 further comprises supporting means for supporting the actuator 14 in relation to the pawl 13 and housing 11. The supporting means are best shown in FIG. 9 comprising supporting legs 77, 78 extending downwardly from the shelf or base 69 of the actuator 14.

Figure 10:
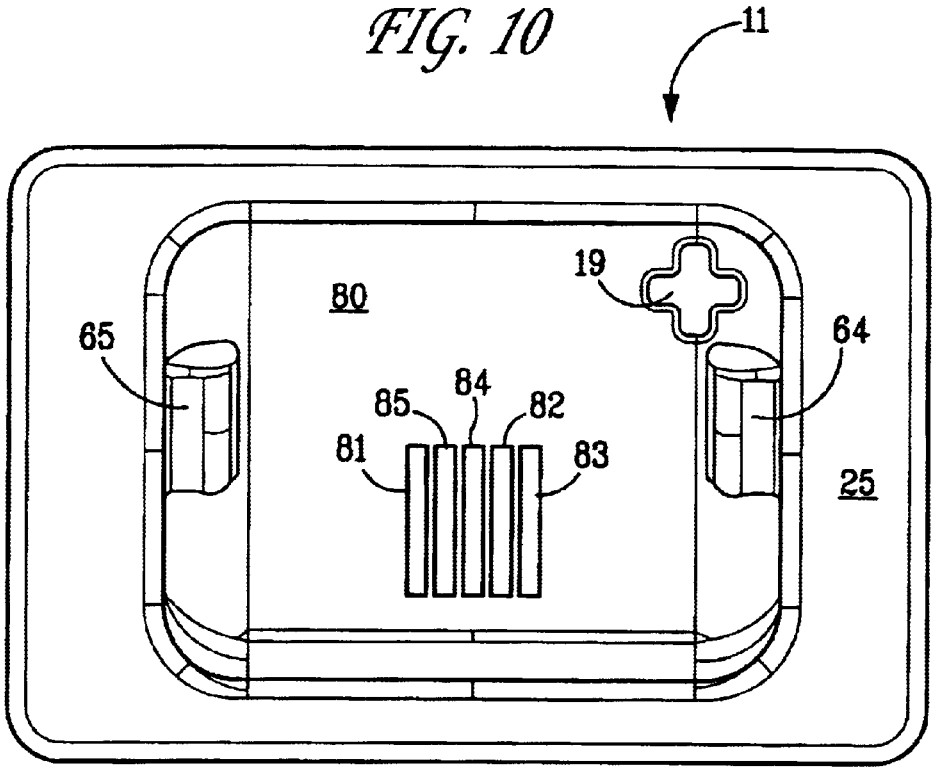
FIG. 10 is a top plan, separate view of the housing of the latch shown in FIG. 1.
Figure 11:
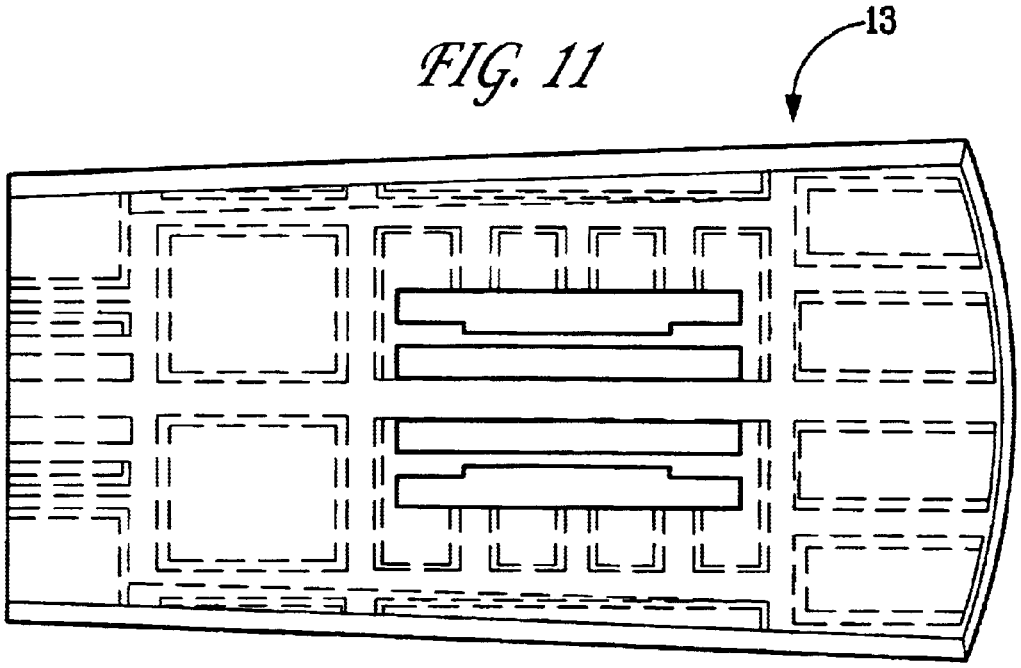
FIG. 11 is a top plan, separate view of the pawl member of the latch of FIG. 1.

FIG. 10 shows the housing 11 with a floor 80 having a plurality of slots 81, 82, 83, 84, 85 disposed therein. The slots 81, 82, 83, 84, 85 are provided to correspond, respectively, with the snap legs 71, 72, stop leg 75, and supporting legs 77, 78 to permit them to pass through the housing floor 80 and into the pawl 13.

The pawl 13 is shown having a plurality of slots 91, 92, 93, 94, 95 disposed therein for accommodating the legs 71, 72, 75, 77, 78 of the actuation member 14 which extend into the slots 91, 92, 93, 94, 95, respectively. Referring to FIGS. 1 and 8, the housing 1 is shown having a pawl slot 50 which is matingly configured to slidably carry the pawl 14 therein. The mating configuration of the slot 50 facilitates alignment of the slots 91, 92, 93, 94, 95 with the housing slots 81, 82, 83, 84, 85, respectively, to enable the legs of the actuator 14 to extend through the pawl slots. The outer slot 85 of the pawl member 13 is partially open on a side thereof. The stop leg 75 of the actuator extends through the outer slot 85. As shown best in FIGS. 2 and 3, the locking element 21 is positioned in the outer slot 85 for selective engagement with the retaining member arm 24. The locking element 21 is maintained within the pawl slot 50 of the housing 11. As shown in FIG. 6, the pawl slot So is defined by the housing floor 80, which defines the top of the slot 50, a rear wall 101, and a bottom wall 102. The pawl 14, spring 15, and locking element 21 are held between the floor 80 and the bottom wall 102.

The pawl 13 is biased with the force of the spring 15 into a forward, engaging position, where the pawl 13 protrudes outwardly from the housing 11. After the pawl 13 has been retracted, the bias from the spring 15 further operates against the pawl 13 to return the pawl to its forward, latching position. The pawl 13 is withdrawn by lifting the handle 12, which forces the handle tab 43 into engagement with the contacting ribs 70 of the actuator 14. The actuator 14 is then forced rearwardly in the housing 11, with the legs 71, 72, 77 and 78 engaging against the rearward end of each respective pawl slot 91, 92, 94, 95, and the rearward end of the stop leg 75 engaging against the locking element 21. The configuration of the present latch 10 allows the pawl 13 to be forced inward into the slot 50 of the housing 11 when encountering a force, such as that from a keeper (not shown). This permits the latch 10 to be slam locked, even when the retaining member 22 is in the locked position. The pawl 13 can be depressed inwardly and the locking member 21 will be accommodated by the outer slot 85 of the pawl 13, when the pawl is forced inward. Of course, the pawl 13, after being forced inward, once it clears a keeper and encounters no further resistance, is biased by the spring 15 toward its outward position, to secure the latch 10.

Figure 12:
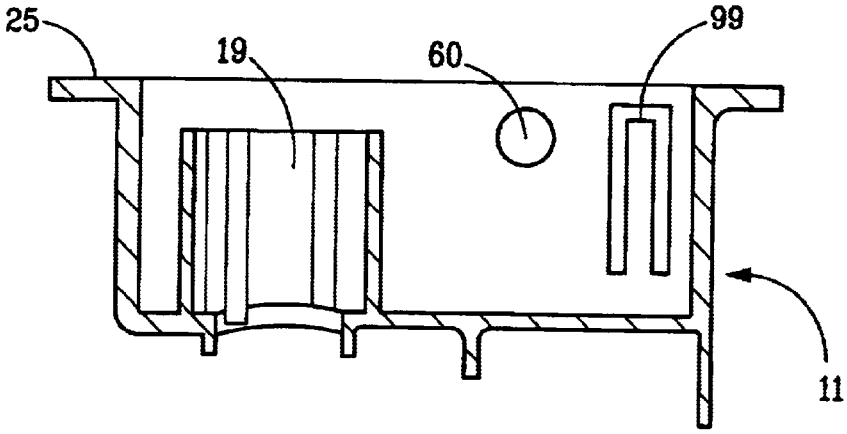
FIG. 12 is a sectional view of the housing shown in FIG. 10, taken longitudinally therethrough.

As shown in FIGS. 1 and 12, detent means for holding the handle 12 in the raised position is shown comprising a resilient engaging element 98, 99 disposed on opposite sides of the housing 11. The detent means preferably can maintain the handle 12 in a raised position until the detent force is overcome by lowering the handle 12.

Figure 13:
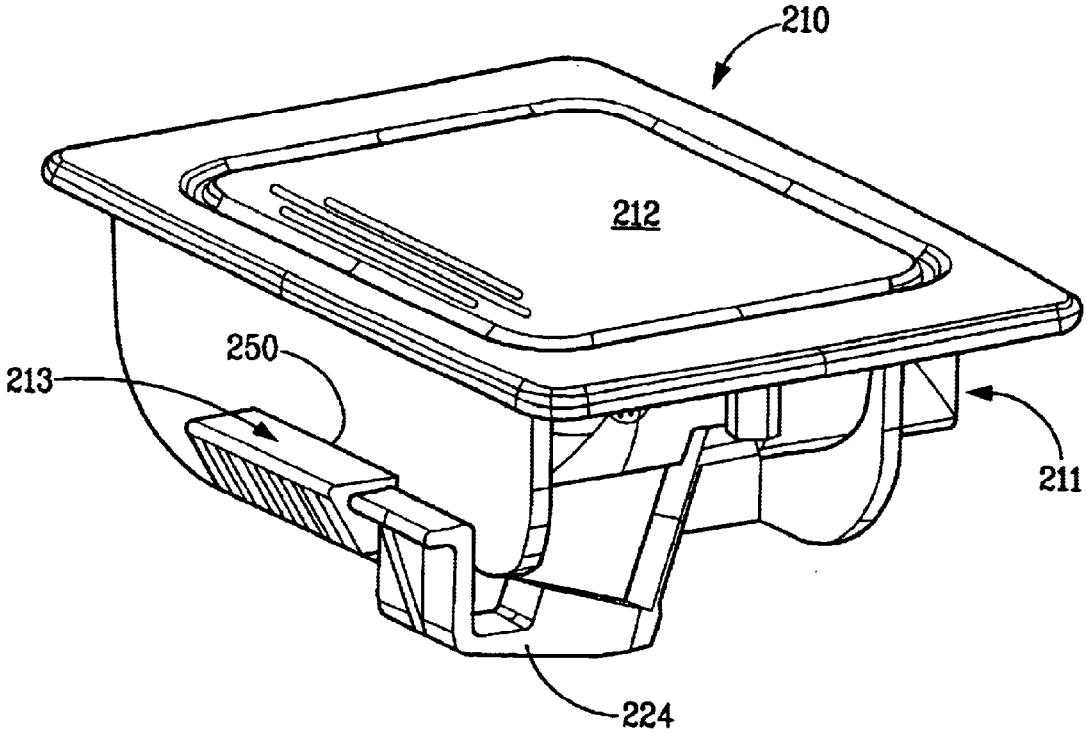
FIG. 13 is a front parallel perspective view of a second alternate embodiment of a latch according to the present invention.

Referring to FIG. 13, a second alternate embodiment of a latch 210 according to the present invention is shown. The latch 210 is similar to the latch 10 of the first embodiment shown and described herein, but having an alternate locking mechanism and an alternate pawl 213, which is configured having a rectangular cross-section to slide within a space 250 provided in the housing 211. The alternate locking mechanism shows locking means comprising a lock plug 222 with a locking pawl arm 224. The locking pawl arm 224 is preferably a spring member to permit slam-action closing of the latch 210 in both conditions, when the locking pawl arm 224 is in the latching (FIG. 12) position, and when the locking pawl 224 is rotated to the side, as shown in FIG. 13, in the open position. The spring force furnished with the locking pawl arm 224 enables the locking pawl arm 224 to snap over a keeper (not shown), and into its locking position.

Figure 14:
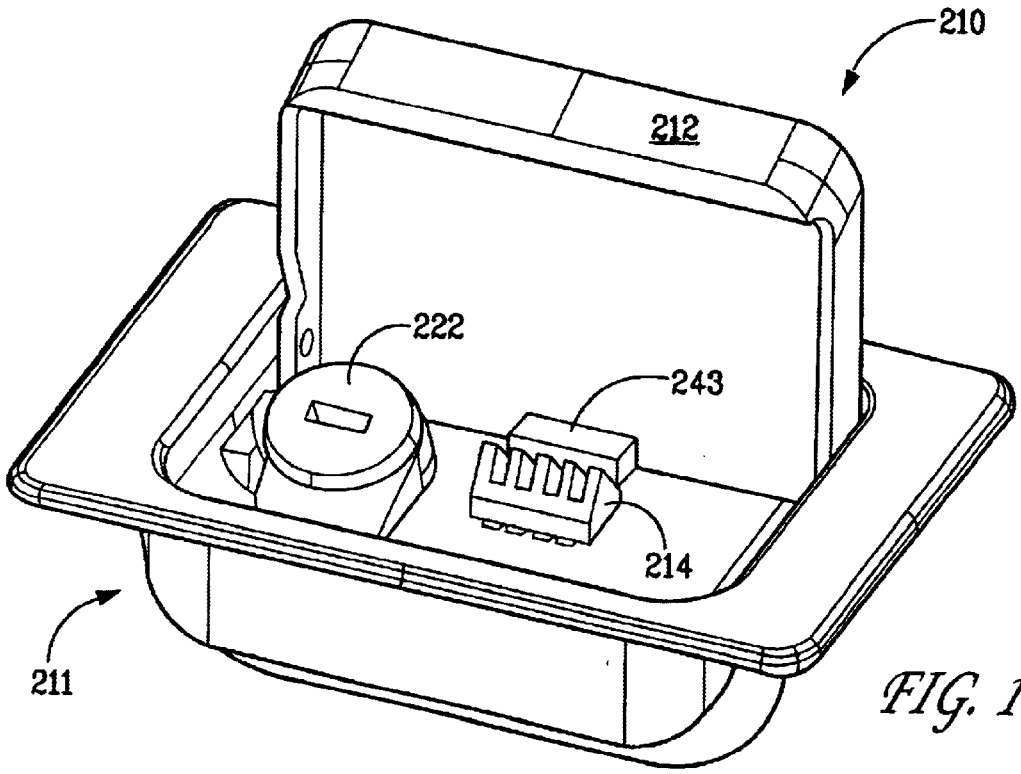
FIG. 14 is a rear parallel perspective view of the second alternate latch embodiment shown in FIG. 13, viewed from the back with the handle in the open position.
Figure 15:
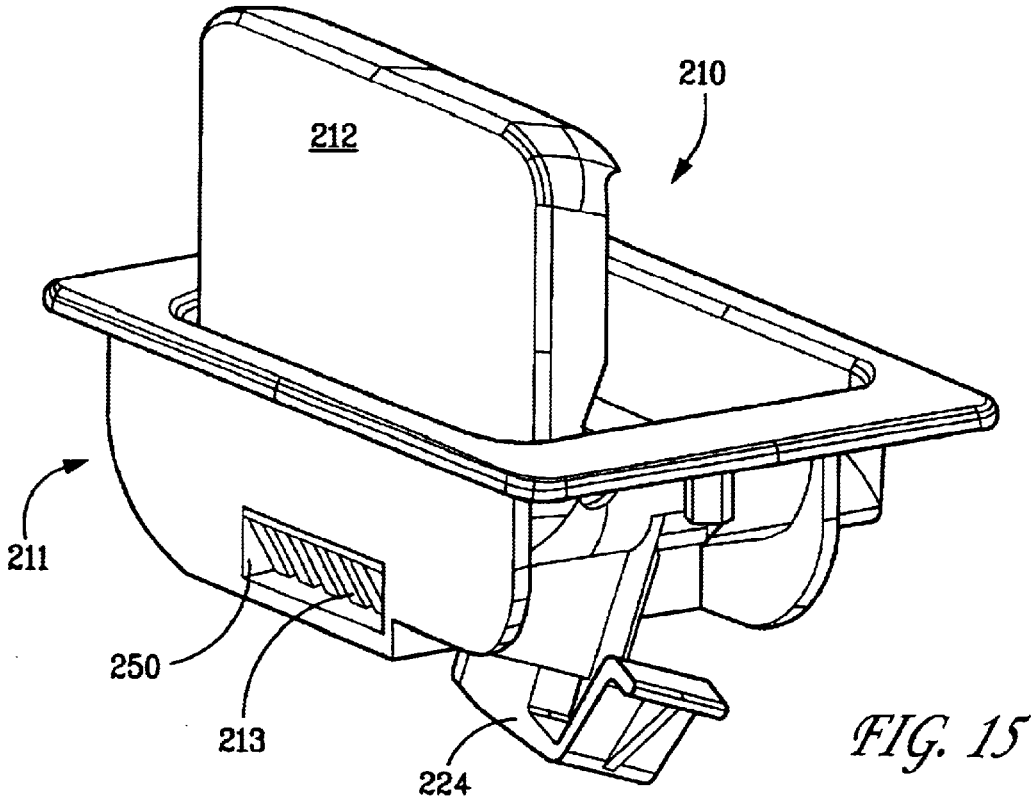
FIG. 15 is a front parallel perspective view of the second alternate latch embodiment shown in FIG. 14, viewed from the front right side with the handle in the open position.

As shown in FIG. 14, the handle 212 is lifted and the handle tab 243 engages the actuator 214 to retract the pawl 213 inwardly within the housing slot 250 (FIG. 15).

Figure 16:
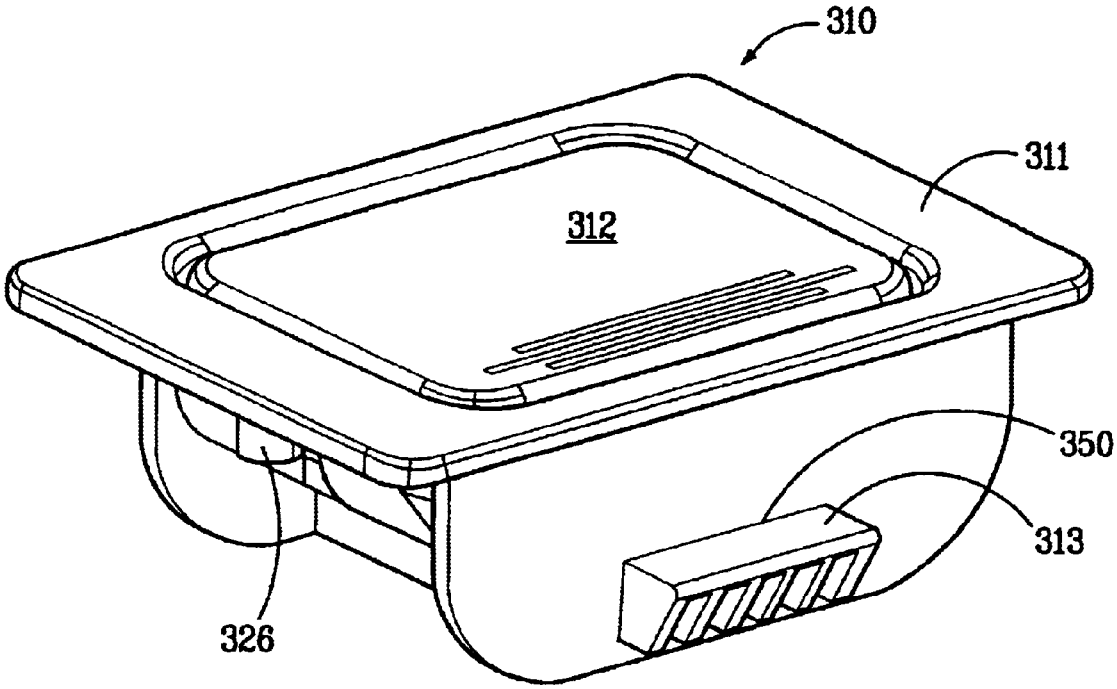
FIG. 16 is a front parallel perspective view of a third alternate embodiment of a latch according to the present invention.
Figure 17:
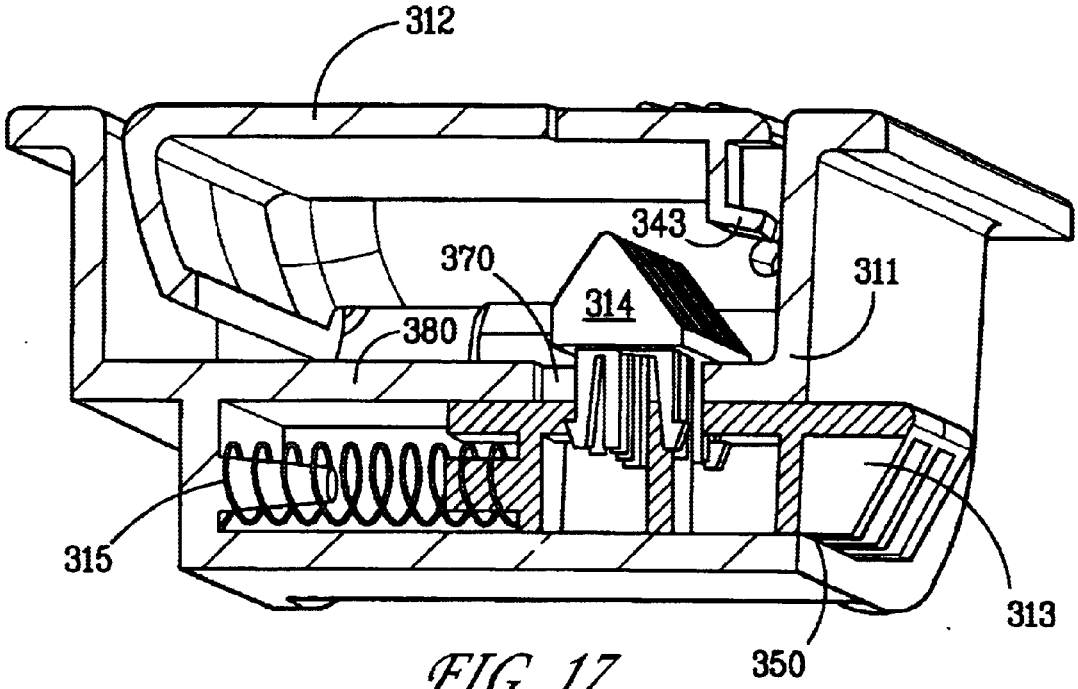
FIG. 17 is a sectional view of the-third alternate embodiment of the latch shown in FIG. 16.
Figure 18:
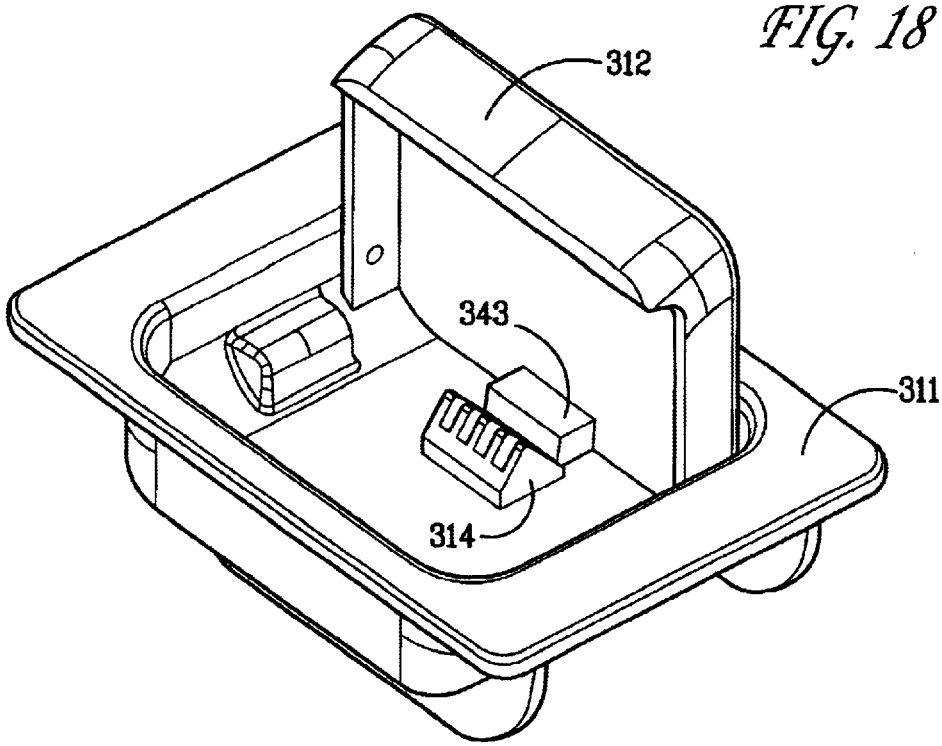
FIG. 18 is a rear parallel perspective view of the third alternate embodiment of the latch of FIGS. 16 and 17, shown with the handle lifted and in the open condition.

Reference now being made to FIGS. 16–18 where a third alternate embodiment of a latch 310 is shown according to the present invention. The latch 310 is provided to operate similar to the latch of the second embodiment 210 described above but without a lock. The latch 310 is shown having a housing 311, a handle 312 pivotally connected thereto, a pawl 13 disposed to slide in a slot 350 of the housing 311, an actuator 314, and a spring 315 which biases the pawl 313 toward a latching position, to protrude outwardly from the housing 311. The actuator 314 can connect with the pawl 313 through a plurality of slots, such as that 370, shown in FIG. 17, which are provided on the housing floor 380. The handle tab 343 is provided to engage the actuator 314 when the handle 312 is lifted, as shown in FIG. 18. Other features, while not shown, such as the detent means described above in connection with the latch 10, can also be employed with the latch 310. The actuator 314 can comprise the same configuration with the same legs as those described above in connection with the actuator 14 of the first embodiment of the latch 10.

As shown in FIG. 16 mounting means is provided on the housing 311, comprising bores, such as that 326 (there being one or more additional bores not shown).

One or more of the features described herein in connection with a latch embodiment disclosed herein, can be employed with another latch embodiment consistent with the principles of the applicant's present invention. Other modifications to the above description can be made consistent with the spirit and scope of the invention disclosed herein. For example, while the keeper is referred to as a separate member, it will be understood that the keeper can comprise a panel, enclosure frame or other surface which the pawl can engage, consistent with the disclosure provided herein. Also, while the present invention is described in connection with a lockplug, it is also understood that a knob, handle or other member can be used to rotate a member into and out of the way of the actuator or secondary keeper (such as with the second alternate embodiment) to regulate the opening and closing.

Figure 19:
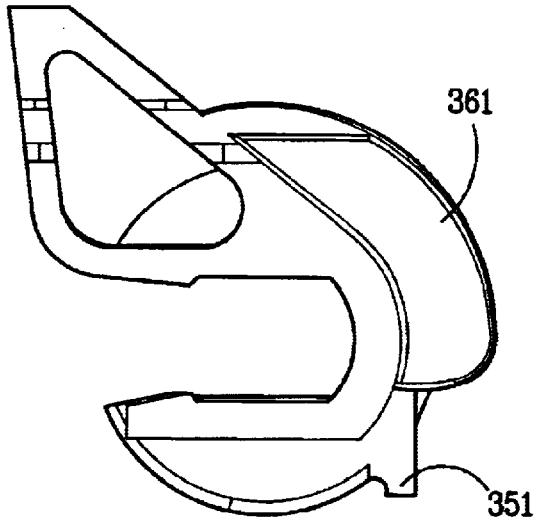
FIG. 19 is an alternative embodiment left side view of the retaining member for use with the embodiments of FIGS. 1–18.
Figure 20:
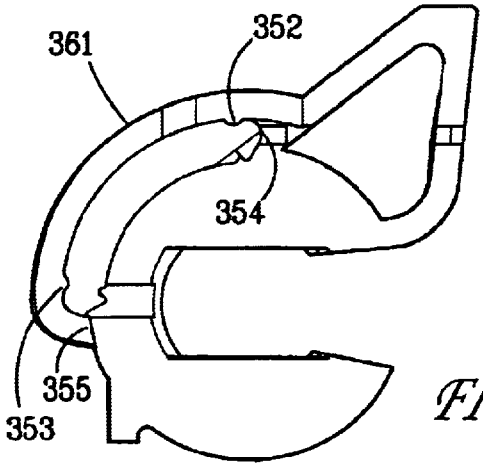
FIG. 20 is a right side view of the retaining member of FIG. 19.
Figure 21:
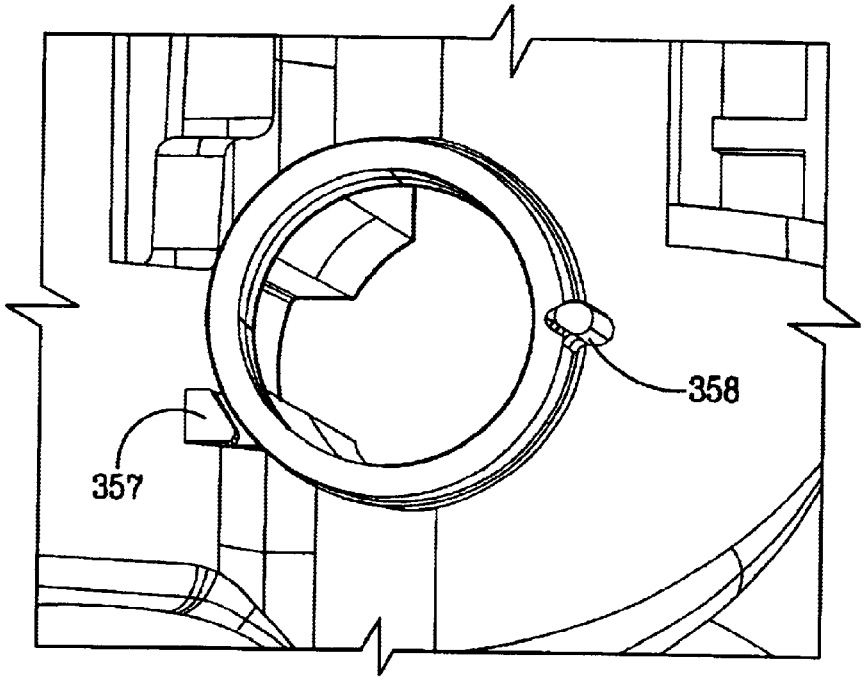
FIG. 21 is an alternative embodiment of the housing for use with the embodiments of FIGS. 1–20.
Figure 22:
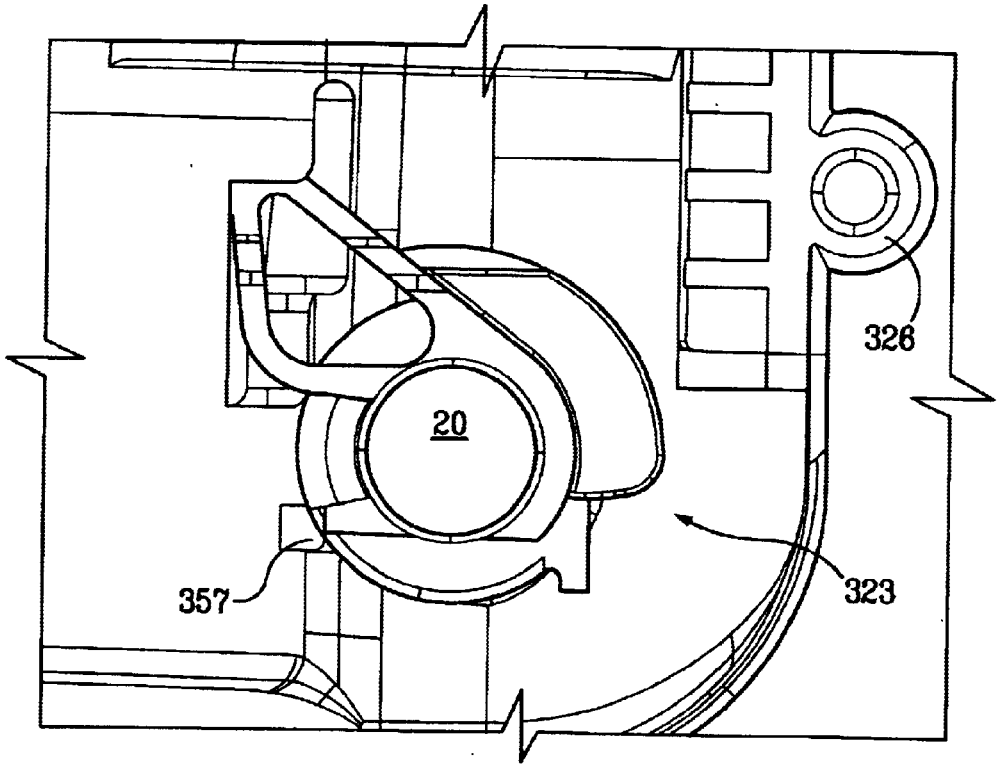
FIG. 22 is a view showing an embodiment of a latch assembly using the retainer and housing of FIGS. 19–21, shown in the locked position.
Figure 23:
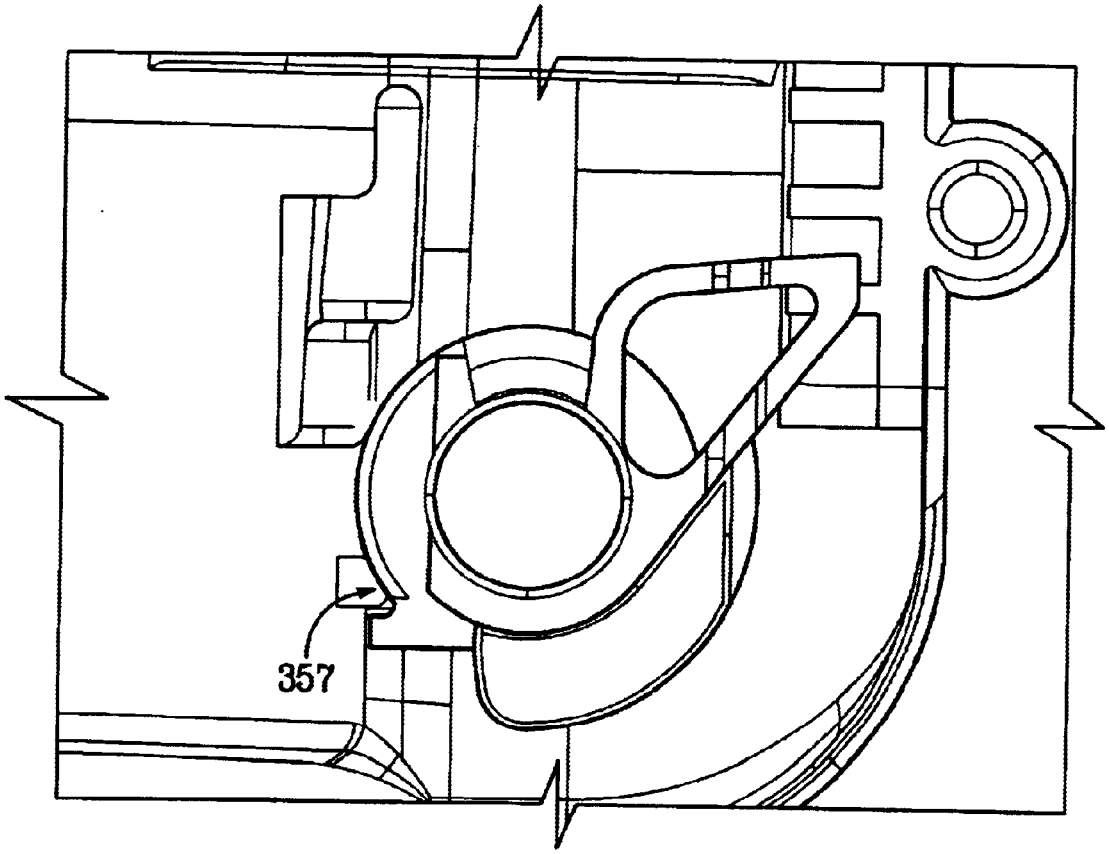
FIG. 23 is a view showing an embodiment of latch assembly using the retainer and housing of FIGS. 19–21, shown in the unlocked position.
Figure 24:
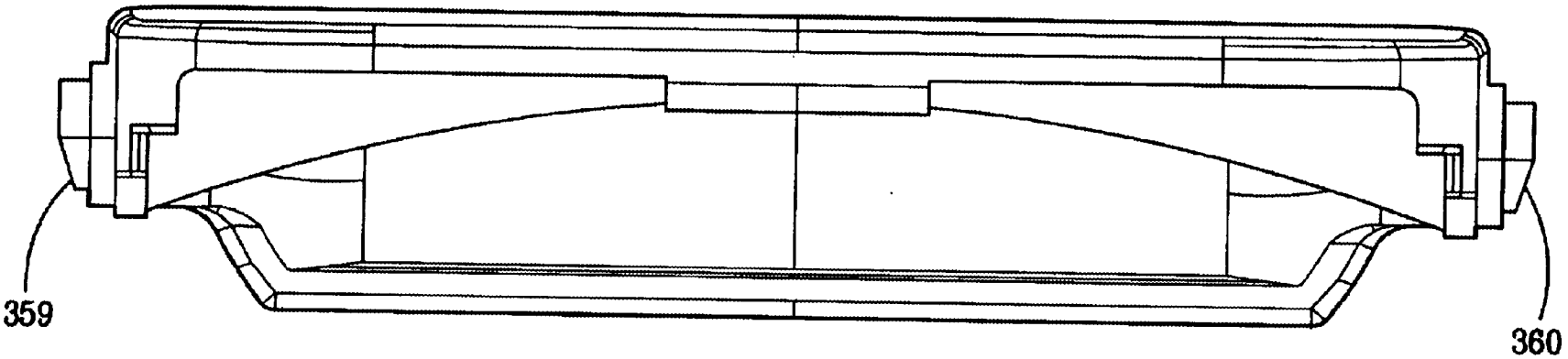
FIG. 24 is an alternative embodiment of the handle for use with the embodiments of FIGS. 1–23.

Also, the retainer can be further dimensioned and configured in different manners. For example, as shown in FIG. 19, an outer ring 361 on the retainer 323 may be included, as well as a pin 351, acting as a stop on the retainer to keep the retainer in the locked position. Moreover, as FIG. 20 demonstrates, additional detent features 352, 353 may be included to better accommodate the lockplug 20. The detent features 352, 353 also may include sidewalls 354, 355 to give more protection against abuse FIG. 21 shows the housing 356 in an alternative embodiment. Here, an additional stop 357 is included to avoid overturning of the lockplug in both directions. This is further shown in FIGS. 22 and 23. Moreover, the stop pin 358 is shown in a bigger size. Also, the mounting hole 326 on the latch is dimensioned and configured to different diameters. In FIG. 24, the chamfers 359, 360 on the handle 12 are shown turned down rather than towards the front. Finally, the alternative embodiment of the latch (shown in FIGS. 19–24) is shown in the closed position in FIG. 25.

Figure 27:
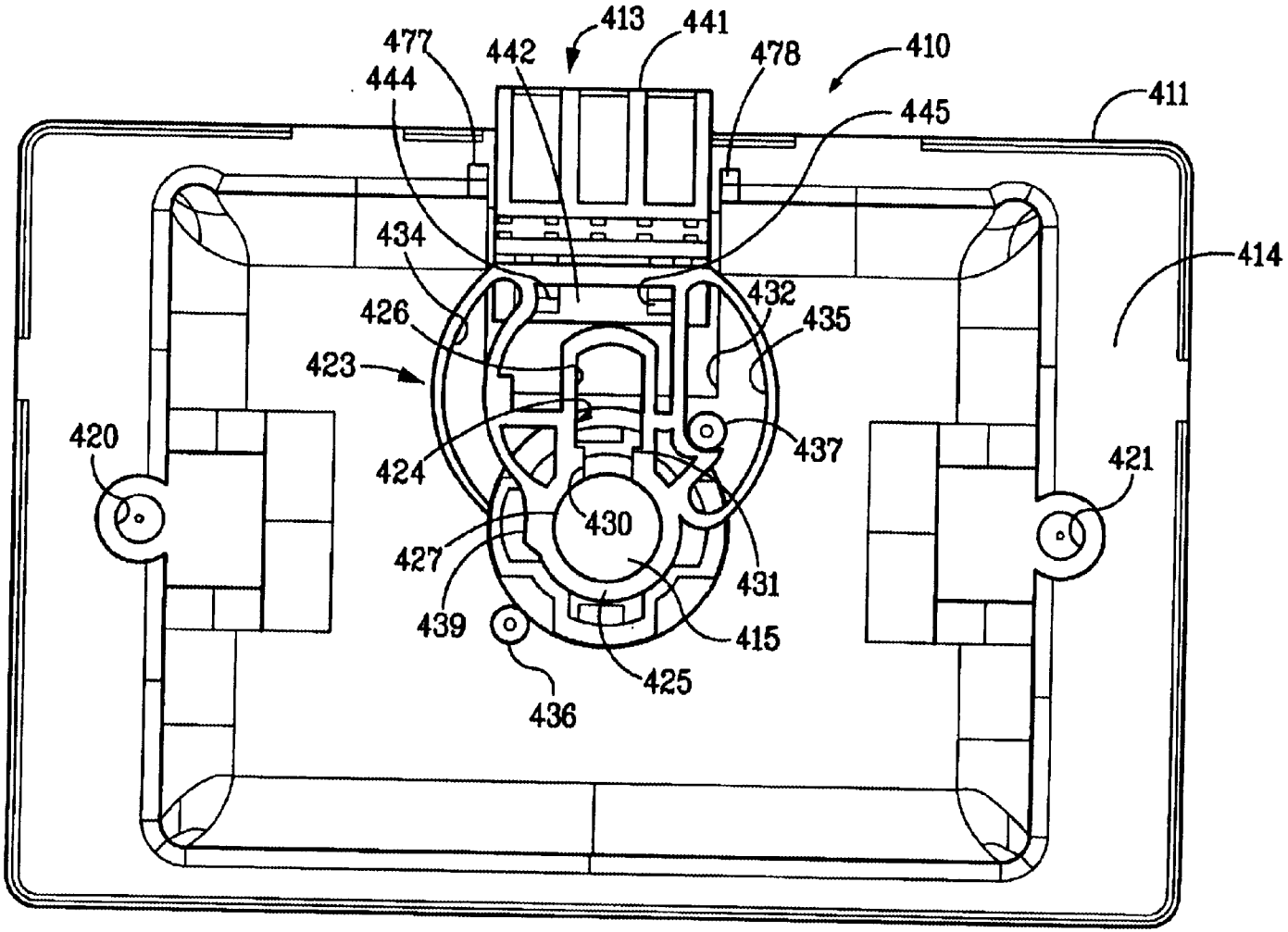
FIG. 27 is a bottom plan view of the latch of FIG. 26, shown with the retaining member partially installed thereon.

Reference being made to FIG. 26, where a latch 410 according to the present invention is shown comprising a latch body or housing 411, a handle 412 and a pawl member 413. The housing 411 has an upper flange 414 which defines the perimeter of the latch 410. As shown in FIG. 27, mounting means is provided on the housing 411, comprising bores 420, 421, which, for example, can be threaded to receive a matingly threaded bolt (not shown) for attachments of the latch 410 to a panel member (not shown). It will be understood that any suitable mounting members, such as, rivets, screws, pins, barbs and the like can be used to secure the housing 411 to a panel. Preferably, the latch 410 can be installed on a floor panel of a vehicle to regulate access to and from a compartment.

Locking means is also provided to lock the latch 410 against unauthorized opening. The locking means is shown comprising a lockplug 415 which has a key slot 416 therein. The locking means further includes retaining means for retaining the lockplug 415 on the housing 411. The retaining means is shown in FIG. 27 comprising a retaining member 423 which is disposed on a connecting end 427 of the lockplug 415 located on the lockplug end opposite of the key slot 416 end. FIG. 27 shows the retaining member 423 during assembly, where it is partially installed on the lockplug connecting end 427. The retaining member 423 has an assembly slot 424 having a circular slot portion 425 and a narrow slot portion 426 extending from the circular slot portion 425. The circular slot portion 425 is configured for placement over the connecting end 427 of the lockplug 415.

Figure 31:
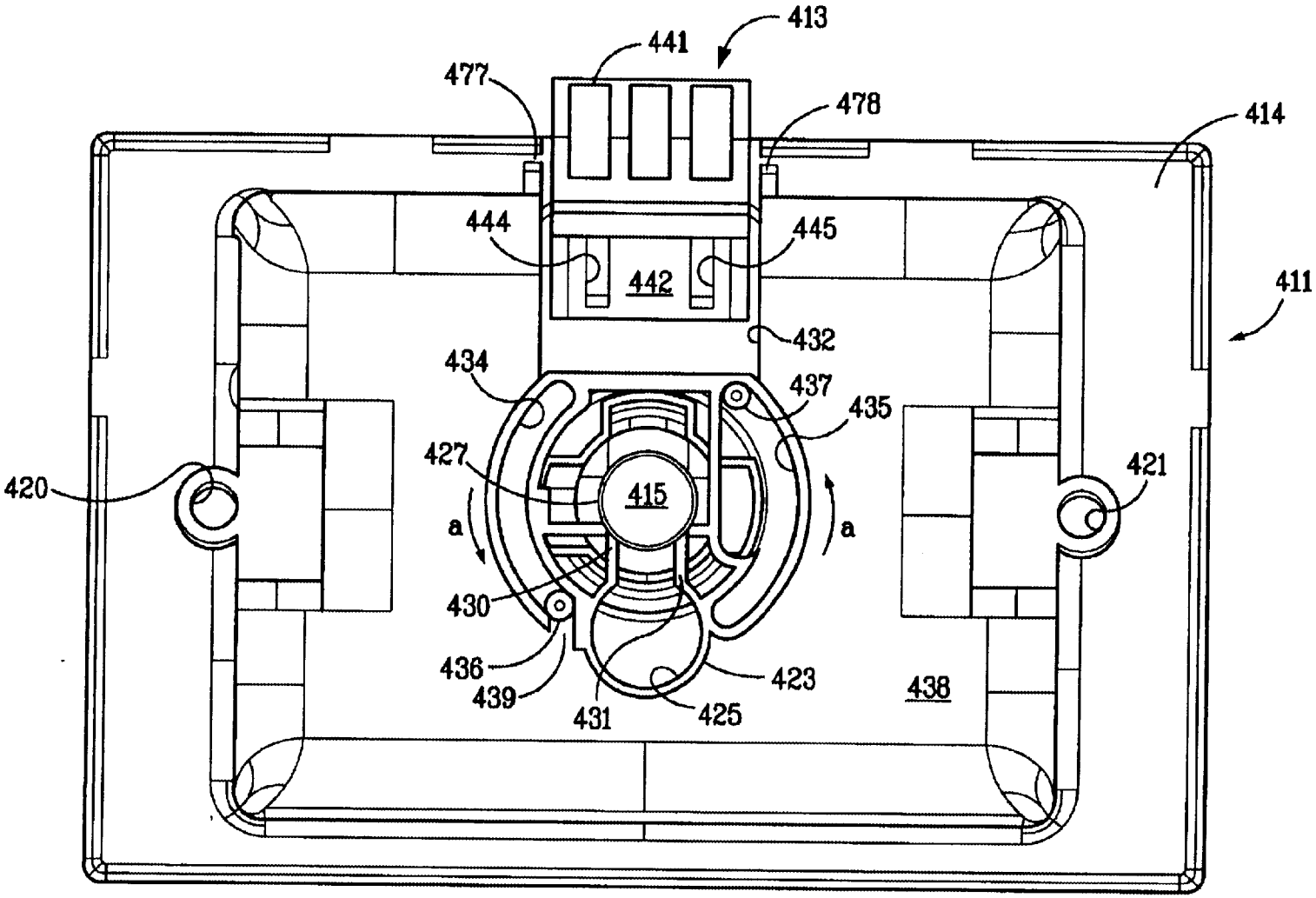
FIG. 31 is a bottom plan view of the latch of FIG. 26 shown with the retaining member in the unlocked position.
Figure 32:
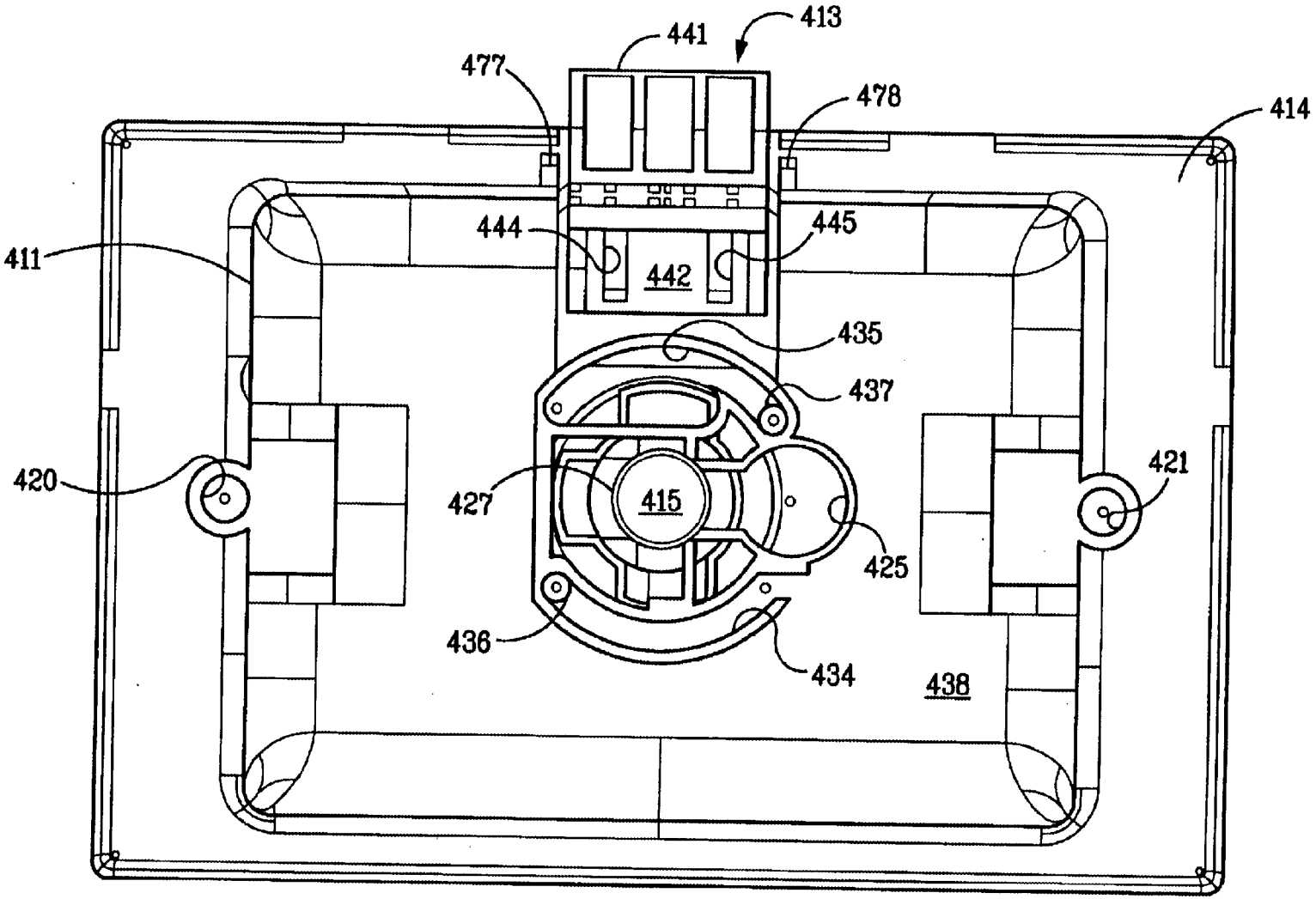
FIG. 32 is a bottom plan view of the latch of FIG. 26 shown with the retaining member in the locked position.

Preferably, the retaining member 423 includes connecting means for connecting it to the connecting end 427 of the lockplug 415 to secure it thereto for corresponding rotational movement with the lockplug 415, i.e., when the lockplug key (not shown) is rotated in the key slot 416. The retaining member connecting means is shown comprising a pair of tapered walls 430, 431 provided on opposite sides of the narrow slot portion 426. The lockplug 415 preferably, is configured for snap-fit installation of the retaining member 423 onto the connecting end 427 by first positioning the circular slot portion 425 over the lockplug connecting end 427, and then sliding the retaining member 423, from its FIG. 27 position, over the connecting end 427 of the lockplug 415, to its installed position as shown in FIGS. 31 and 32. The retaining member 423 has a first cam slot 434 with an opening 439. Likewise, the retaining member 423 also has a second cam slot 435 having an enlarged slot portion to facilitate installation of the retaining member 423 on the lockplug connecting end 427. First and second pin members respectively, 436, 437 are provided on the housing 411 to facilitate holding the retaining member 423. The opening 439 of the first cam slot 434 allows the first cam slot 434 to be moved along the first pin member 436, and the enlarged slot portion of the second cam slot 435 facilitates installation and movement of the second cam slot 435 along the second pin member 437.

Figure 28:
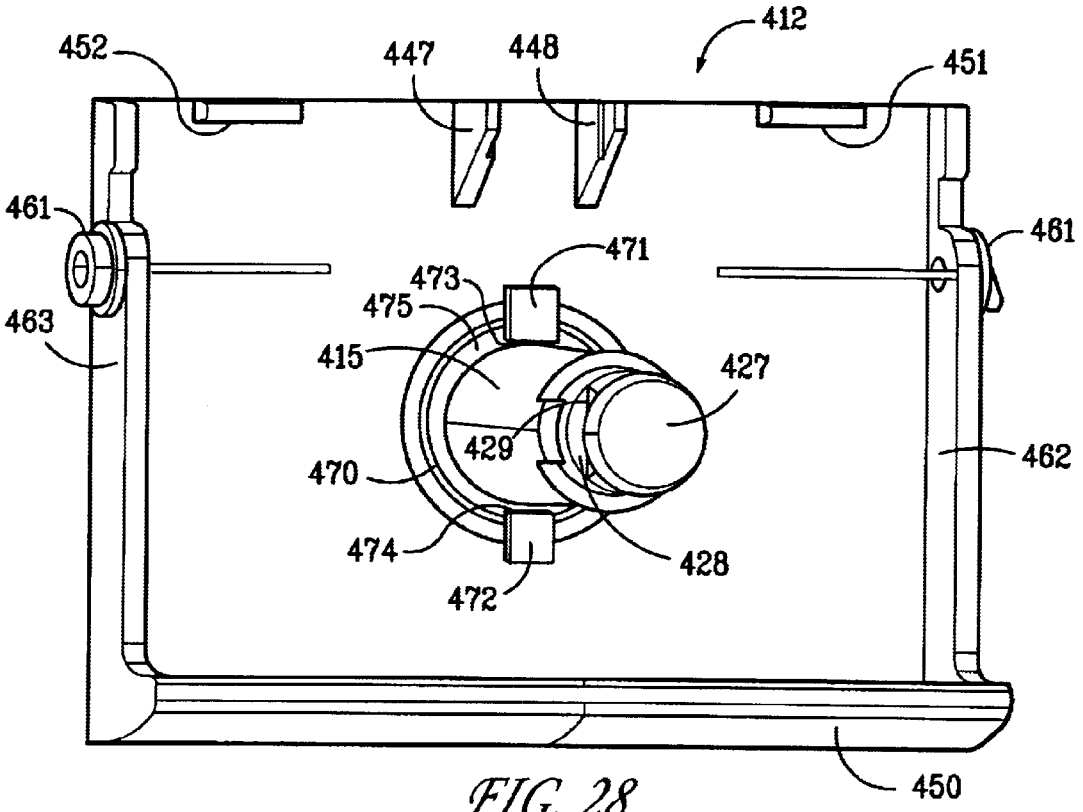
FIG. 28 is a rear parallel perspective view of the handle of the latch shown FIGS. 25 and 27, shown with a lockplug installed thereon, as viewed from the left.

As shown in FIG. 28, the lockplug 415 preferably has an annular groove 428 disposed at the connecting end 427. This permits the retaining member 423 to slide along the groove 428 and snap the narrow slot portion 426 onto the connecting end 427. The tapered walls 430, 431 maintain the retaining member 423 on the connecting end 427 of the lockplug 415. Preferably, the groove 428 has at least two vertical components, such as the vertical wall 429, only one side being shown, there being an identical vertical wall portion on the opposite side.

Figure 29:
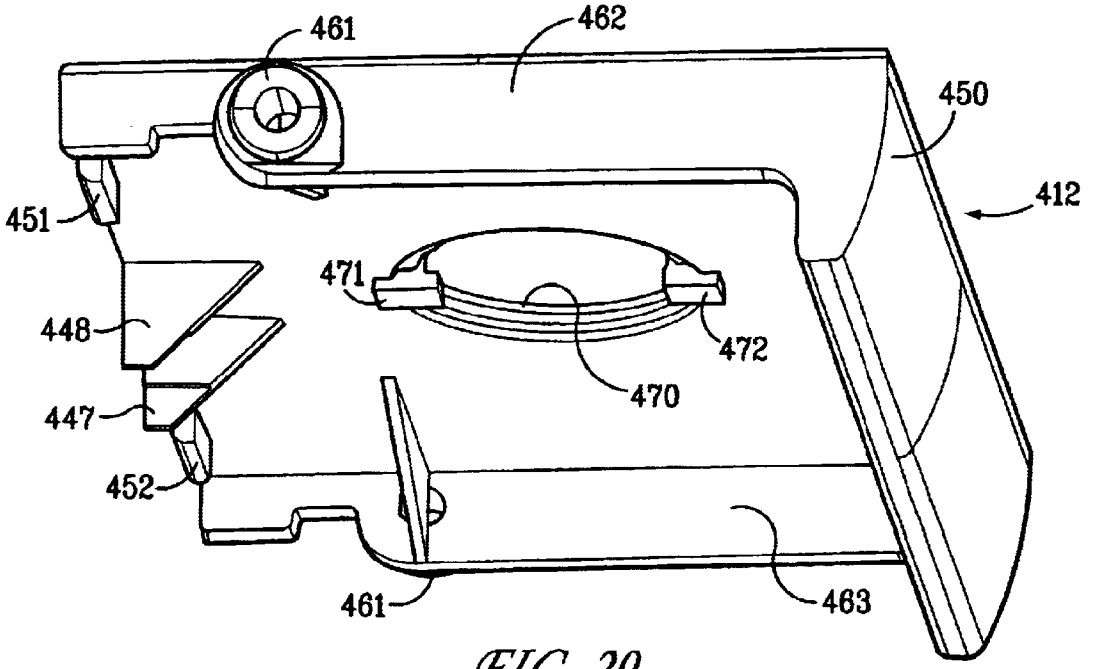
FIG. 29 is a parallel perspective view of the handle of the latch of FIGS. 26–28, as viewed from the bottom.
Figure 30:
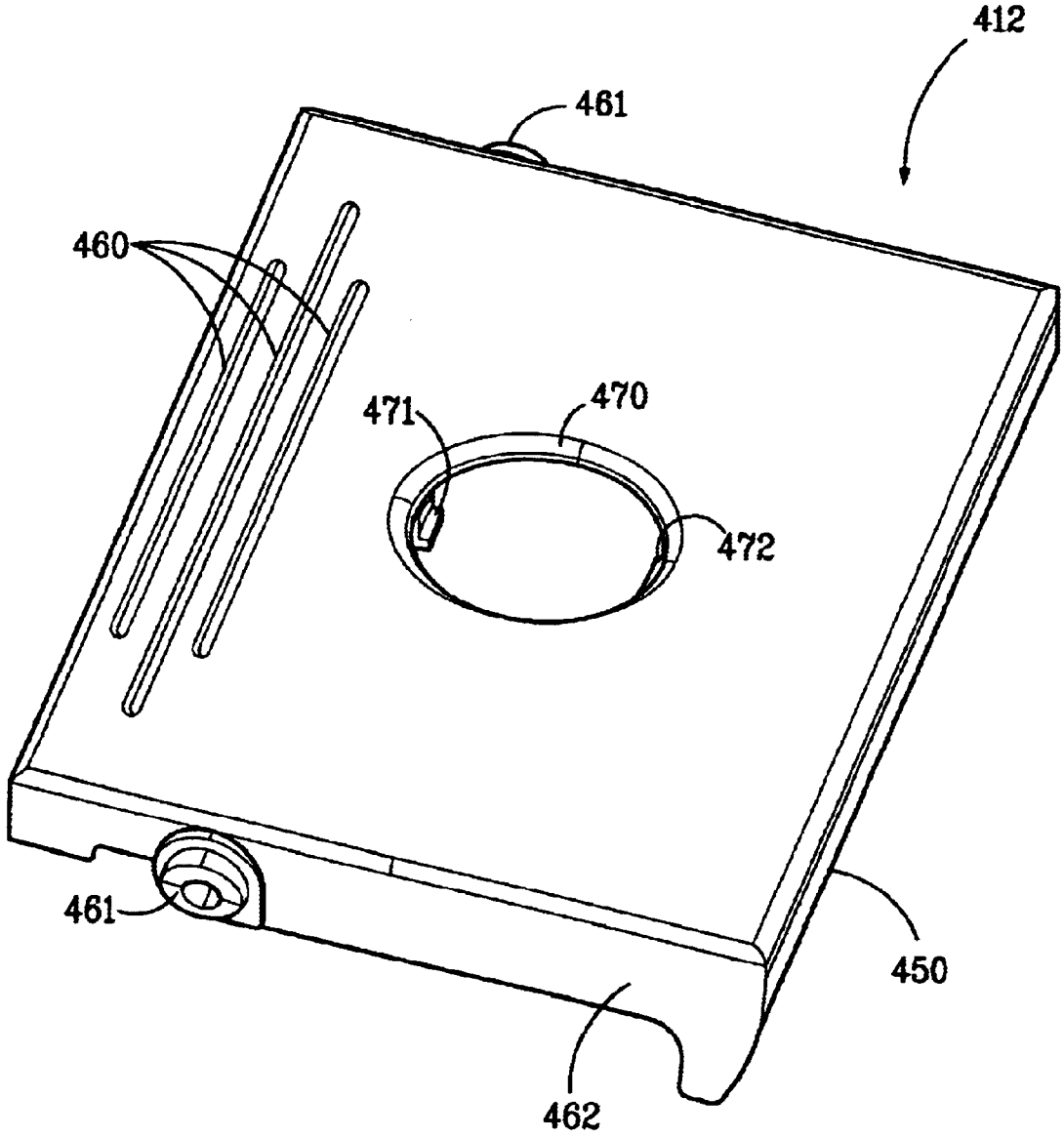
FIG. 30 is a parallel perspective view of the handle shown in FIG. 29, as viewed from the top.

Referring to FIGS. 29 and 30, the handle 412 is provided with an aperture 470 to permit the lockplug 415 to be installed therein. A pair of locking legs 471, 472 is disposed on opposite sides of the aperture 470. The locking legs 471, 472 preferably comprise generally L-shaped members. The lockplug 415 is provided with an upper ring portion 475 which is disposed to rotate with a key (not shown). The lockplug 415 has notches 473, 474 disposed in the upper ring portion 475 which are rotated to block the locking legs 471, 472 of the handle 412 and to release the locking legs 471, 472 when the notches 472, 473 are aligned with the locking legs 471, 472. In FIG. 26, the locking legs 471, 472 are shown positioned in a horizontal alignment. In this (FIG. 26) position, the handle 412 is restrained from lifting relative to the housing 411, and the pawl member 413 cannot be moved to unlatch the latch 410 from a keeper.

FIG. 28 shows the position of the handle locking legs 471, 472, which are vertically disposed in relation to the notches 472, 473. When the upper ring portion 475 of the lockplug is rotated in either a clockwise or counterclockwise direction, and the notches 472, 473 are aligned with the locking legs 471, 472 of the handle (FIG. 28), the handle 412 can then be lifted for pivoting to engage the pawl member 413. The pawl member 413 is retracted rearwardly into the housing when the handle 412 is fully pivoted (as shown best in its FIG. 35 position). The housing 411 has a cut-out portion 432 disposed in the vicinity of the pawl member 413 to permit the pawl member 413 to be retracted with the handle 412 and/or deflected inwardly, toward the housing 411.

Preferably, the housing includes flange members 477, 478 disposed on each side of the pawl member 413 and extending parallel to the length of the pawl member 413. The flange members 477,478 are provided to facilitate clearance of the latch 410, with a keeper member or surface.

Referring now to FIGS. 31 and 32, the retaining member 423 is installed on the connecting end 427 of the lockplug 415. The housing first pin member 436 and second pin member 437 extend outwardly from the rear surface 438 of the housing 411. The first cam slot 434 and second cam slot 435 are positioned for movement along the respective first pin member 436 and second pin member 437 when the lockplug 415 is operated by turning a key (not shown) to rotate the upper ring or locking member 475. The retaining member 423 rotates with the upper ring or locking member 475 of the lockplug 415. The retaining member 423 is shown in FIG. 31, with the lock in the open position and can be rotated from that position, along the direction of arrow "a," to the latch's locked position (FIG. 32). When the lockplug 415 is in the locked position, the lockplug upper ring or locking member 475 secures the handle 12 against pivotal movement, i.e. lifting, by retaining the locking legs 471, 472 of the handle 412. During the movement from the open position to the closed or locked position, the retaining member 423 travels along the first and second pin members 436, 437 which facilitate guiding of the retaining member movement. The retaining member 423 secures the lockplug 415 to the housing 411 and prevents the lockplug 415, from otherwise being lifted out of the latch 410 with the handle 412. When the lockplug 415 interferes with the locking legs 471, 472 of the handle 412, then the handle 412 is not able to freely move and it cannot pivot to engage the pawl member 413.

Figure 33:
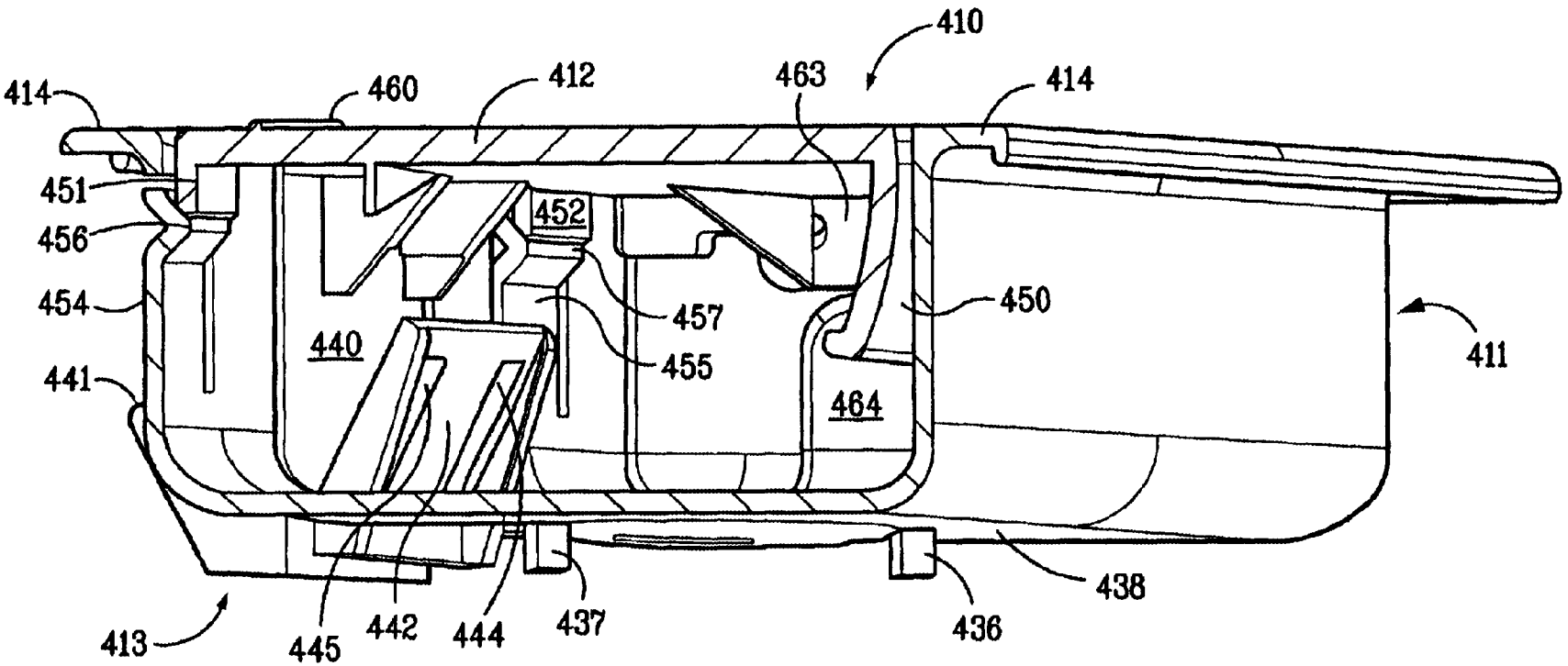
FIG. 33 is a left side, parallel perspective sectional view of the latch of FIG. 26, shown in the closed position.
Figure 35:
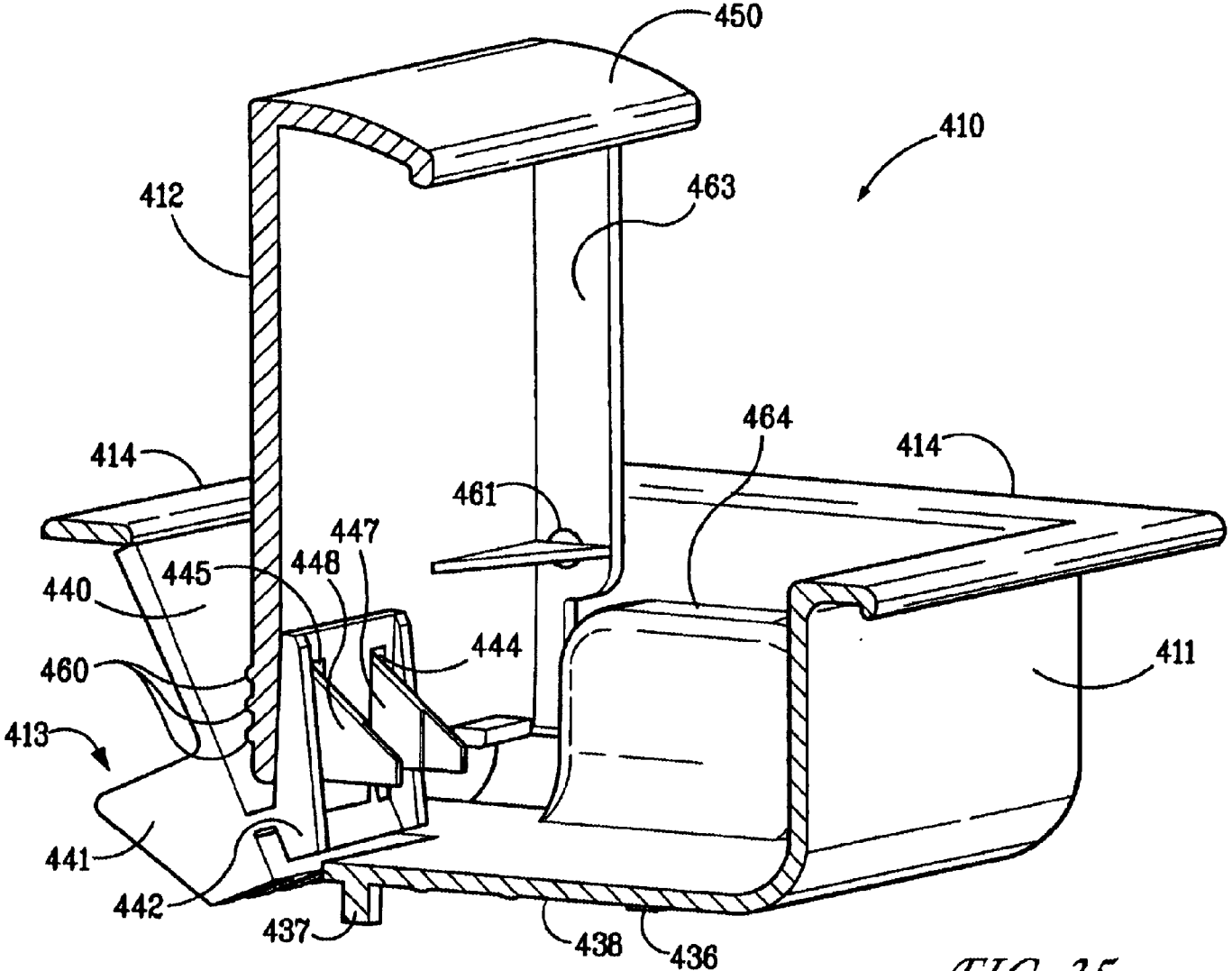
FIG. 35 is a left side, parallel perspective sectional view of the latch of FIGS. 26–30 shown with the handle in its fully raised position and the pawl member retracted.

Reference now being made to FIG. 33, wherein the pawl member 413 is shown having a leg portion 440 which is connected to the housing 411 and extends downwardly from the housing flange 414. Preferably, the pawl member 413 comprises a living spring member, which, as shown in FIG. 35, permits the pawl member 413 to be moved along a generally radial path through the movement of the leg portion 440 when the handle 412 is actuated.

The pawl leg portion 440 has an engaging foot 441 which is provided for engaging a keeper member, and an actuating foot 442 which the handle 412 engages to deflect the pawl member 413 away from the keeper so the latch 410 can be opened. As shown best in FIG. 33, the pawl actuating foot 442 has a pair of slots 444, 445 disposed therein. The handle 412 is shown in a partially lifted position and has actuating means for engaging the pawl member 13. Preferably, the actuating means comprises a pair of fingers 447, 448 which engage the actuating foot 442 of the pawl member 413 to retract the pawl member 413 and draw it into the housing 411 away from the keeper member. The actuating fingers 447, 448 are provided to grip the pawl member 413 by protruding into the slots 444,445, as shown in FIGS. 34 and 35.

Preferably,the handle 412 has a lifting portion 450 which can be gripped by a user to pivot the handle 412 for engagement with the pawl member 413. The handle 412 is pivotally connected to the housing 411 for pivotal movement relative thereto. Referring again to FIGS. 28–29, the handle 412 includes limiting elements, such as, for example, positioning tabs 451,452 disposed thereon and provided on opposite sides of the pawl member 413. The housing 411, referring to the views of FIGS. 33–35, has handle stop means comprising a pair of locking legs 454, 455 disposed on opposite sides of the pawl member 413 at locations corresponding to the handle positioning tabs 451, 452. The locking legs 454, 455 preferably are resilient members and can comprise spring arms which are provided for deflection relative to the housing 411. The locking legs 454, 455 each have an engaging element, such as, for example, a stop element 456, 457, respectively, disposed at each upper end thereof The stop elements 456, 457 of the locking legs 454, 455 cooperate to engage the positioning tabs 451, 452, to retain the handle 412 in a flat position, level with the housing flange 414, when the latch 410 is secured to a keeper or in its closed position, as shown in FIGS. 26 and 33.

Figure 34:
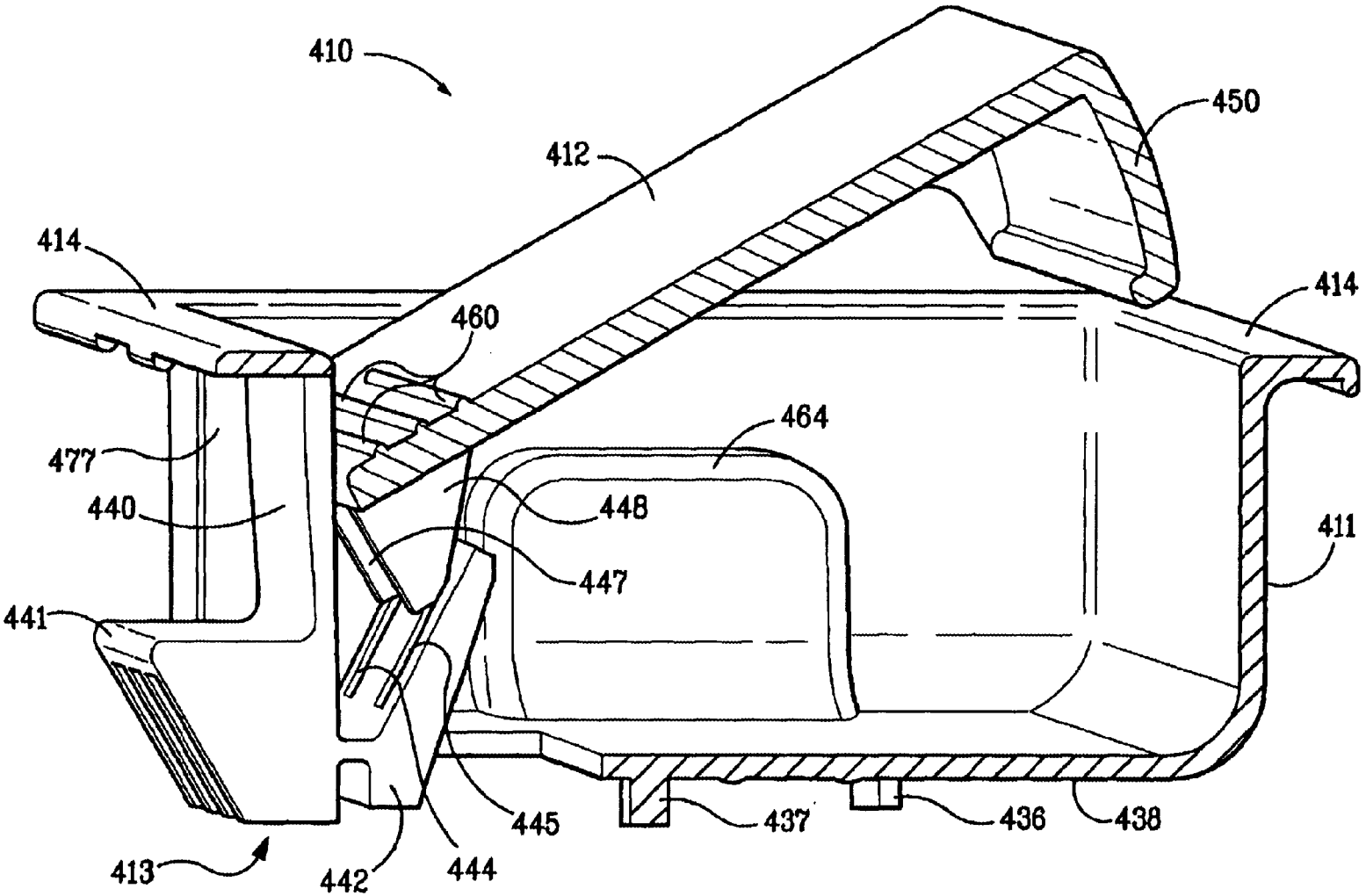
FIG. 34 is a left side, parallel perspective sectional view of the latch of FIGS. 26–30 shown with the handle in a partially raised position.

Referring to FIG. 34, the locking legs 454, 455 (while shown in other FIGS.) can facilitate the positioning of the handle 412 for unlatching by maintaining it in the position shown. The handle 412 preferably can include tread means, shown comprising a series of raised projections 460 disposed on the top surface thereof. To open the latch 410, the handle 412 can be depressed by pressing on the raised projections 460 to pivot the handle actuating fingers 447, 448 in the direction of the pawl actuating foot 442. The stop elements 456, 457, preferably, are disposed to maintain the handle 412 in a partially raised position (FIG. 34) to permit further lifting of the handle 412 with the lifting portion 450, which is accessible when the handle 412 is partially raised.

Referring now to FIG. 35, the handle 412 is shown in its fully actuated position with the pawl member 413 retracted. The handle 412 preferably is provided with a pair of pintles 461 at opposite sides thereof (see FIG. 28) for pivotally connecting the handle 412 to the housing 411. The housing 411 can be provided with apertures or grooves (not shown) in which the handle pintles 461 can be seated for pivotal movement. It will be further understood that other suitable connecting means for pivotally attaching the handle 412 to the housing 411 can be utilized consistent with the scope of the invention described herein. For example, the housing can be provided with the pintles and the handle 412 can have apertures for receiving the pintles. Other alternate connecting arrangements are possible including the utilization of pins, bolts, and the like.

As shown best in FIGS. 28, 29 and 35, the handle 412 has side flanges 462, 463, which facilitate alignment of the handle 412 relative to the housing 411. The housing 411 is provided with a ledge 464, as shown in FIG. 32, there being a ledge on the opposite side of the housing 411 (not shown). The ledge 464 provides a seat for the handle side flange 463 when the handle 412 is in its closed (FIG. 26) position. The handle 412 preferably has a second flange 462 on the opposite handle side, which can rest on a housing ledge on that side (not shown).

Figure 36:
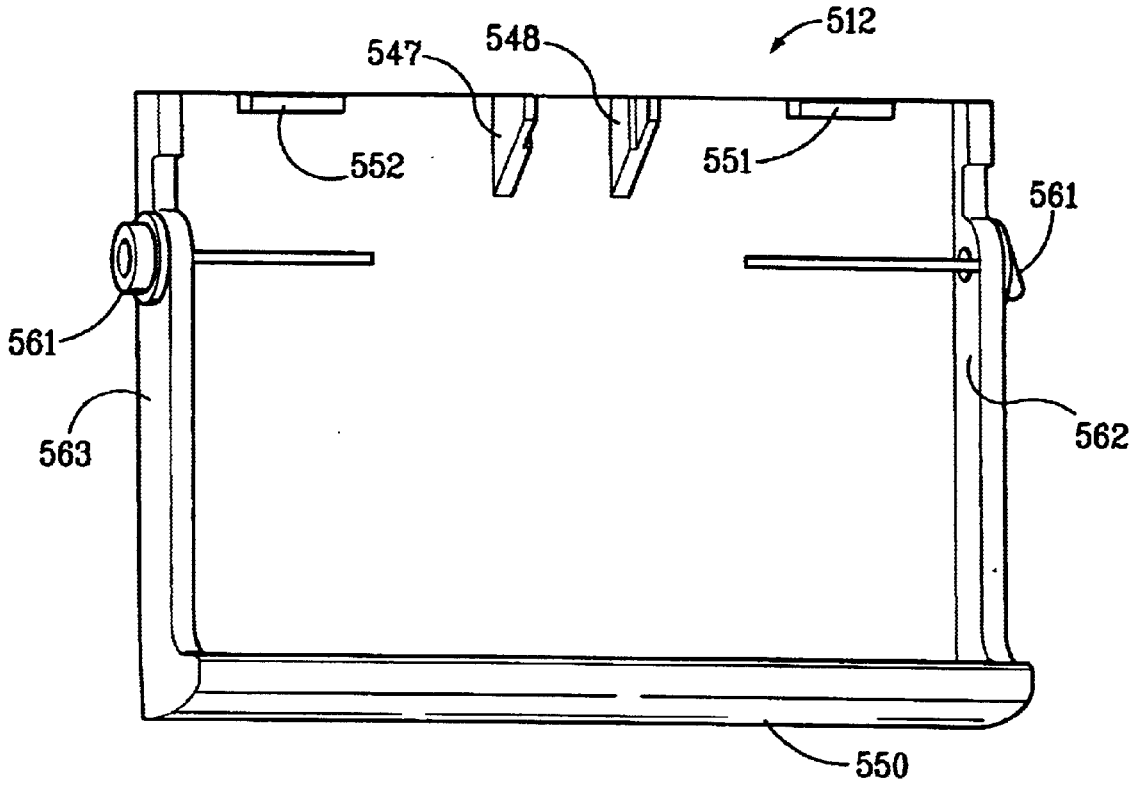
FIG. 36 is an alternate embodiment of a handle for use with the embodiments of FIGS. 26–46 of the latch according to the present invention.

Referring now to FIG. 36, an alternate embodiment 512 of the handle 412 according to the present invention is shown. The handle 512 is similar to the handle 412 shown and described above in relation to that of the latch embodiment of FIGS. 26–35, but does not include a lockplug opening. The handle 512 has a lifting portion 550 and a pair of pintles 561 disposed on each side thereof for mounting the handle 512 to the housing 411. The handle 512 further has actuating fingers 547, 548, positioning tabs 552, 553, and flanges 562, 563 disposed at each side thereof. The handle 512 is provided to function similar to the handle 412, but without provision for the locking means.

Figure 37:
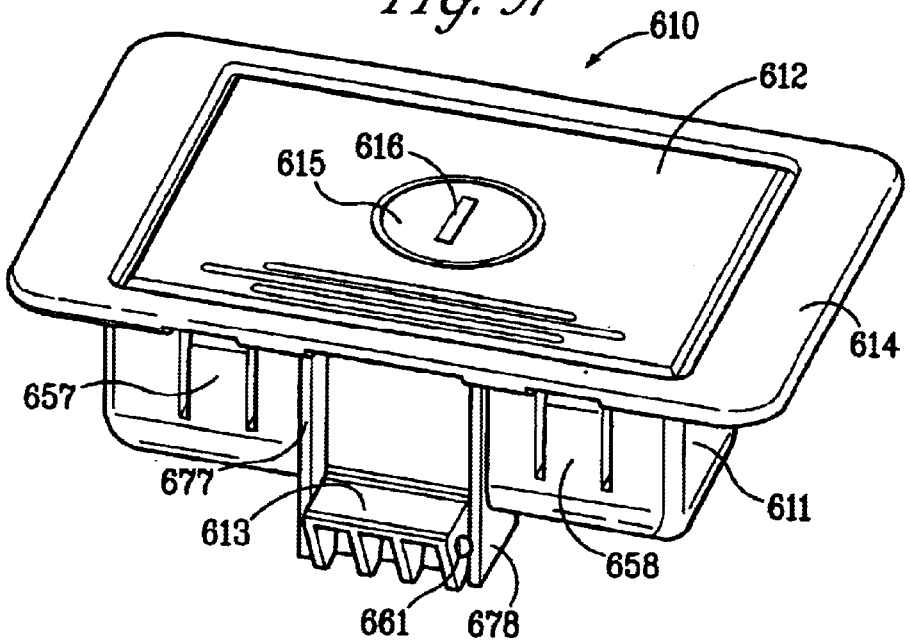
FIG. 37 is a front parallel perspective view of a fifth alternate embodiment of a latch according to the present invention.

Reference now being made to FIG. 37, a fifth embodiment of a load floor latch 610 is shown, comprising features similar to the first alternate embodiment, with an alternate locking configuration and with means for facilitating securing of a pawl with a keeper. The fifth embodiment of the latch 610 is shown comprising a latch body or housing 611, a handle 612 and a pawl member 6113. The housing 611 preferably, can have an upper flange 614 which defines the perimeter of the latch 610.

Figure 39:
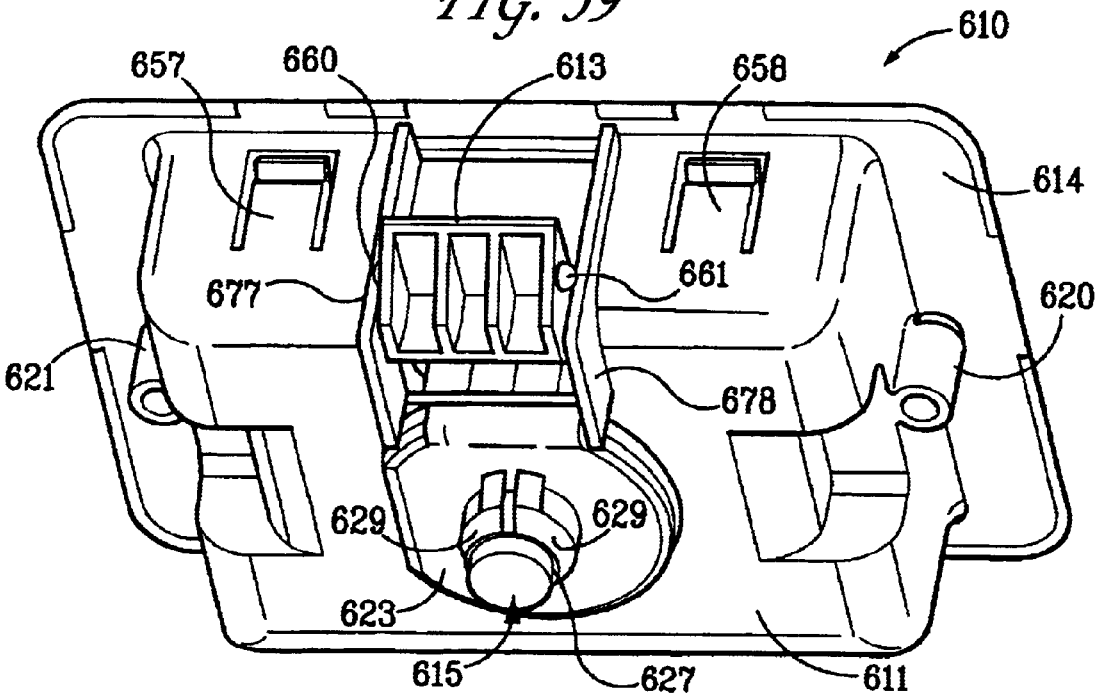
FIG. 39 is a bottom parallel perspective view of the embodiment of the latch shown in FIG. 37.
Figure 42:
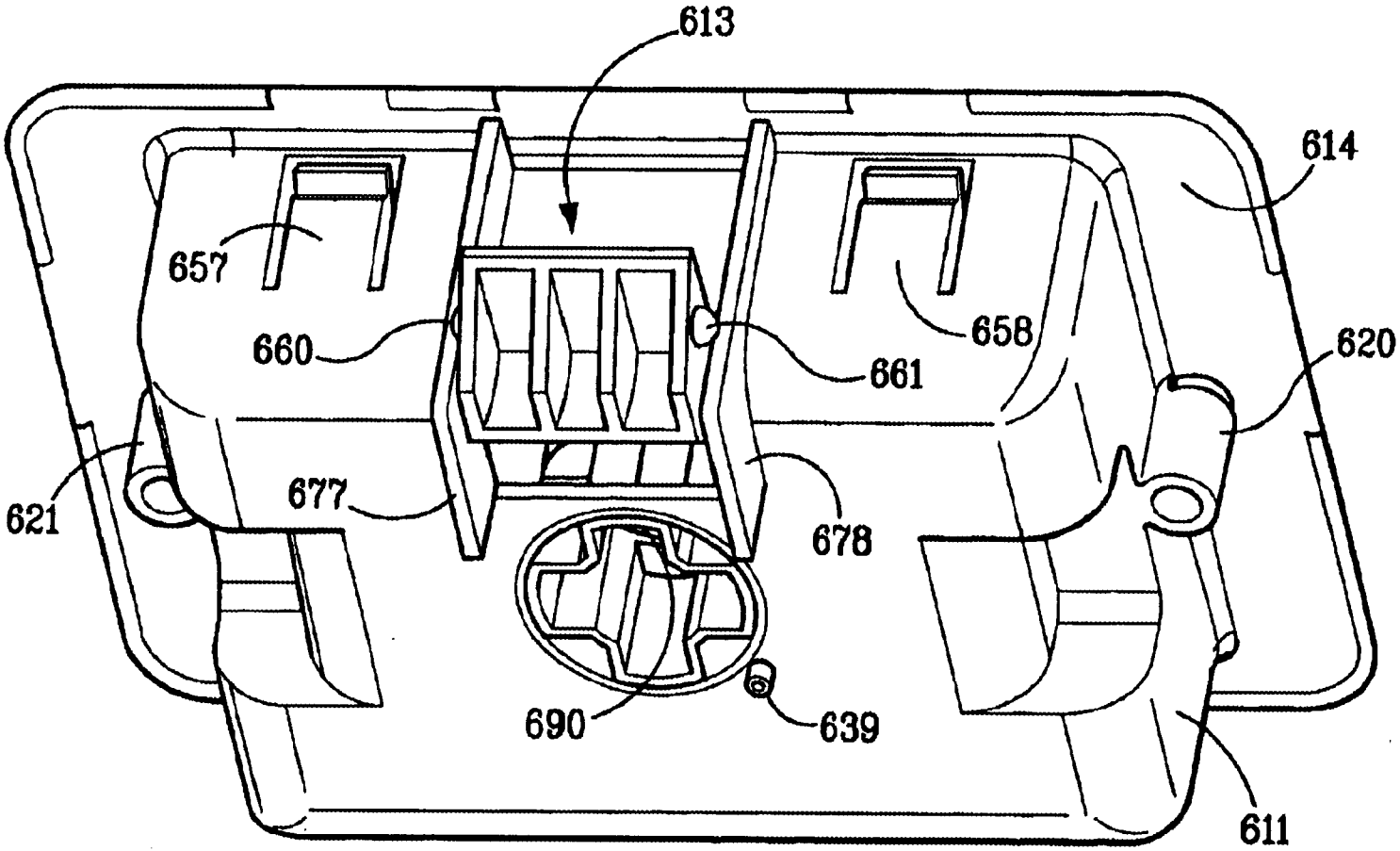
FIG. 42 is a rear parallel perspective view of the housing of the embodiment of the latch shown in FIG. 37.

As shown in FIGS. 39 and 42, mounting means is provided on the housing 611, comprising bores 620,621, which, for example, can be threaded to receive a matingly threaded bolt (not shown) for attachment of the latch 610 to a panel member (not shown), in the manner that the latch 410 can be mounted, as described above. In addition, locking arms 657,658 can also be provided to function similar to the locking arms 454, 455 of the latch embodiment 410 previously described herein.

Figure 38:
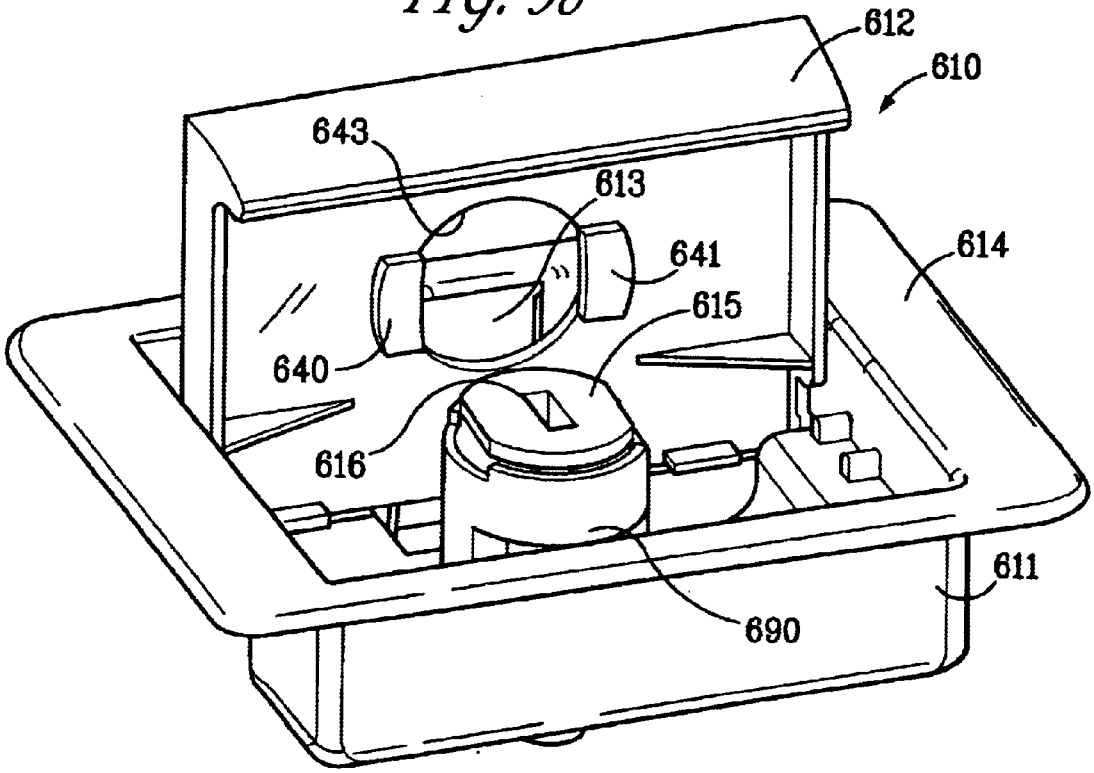
FIG. 38 is a rear parallel perspective view of the latch embodiment shown in FIG. 37, viewed from the back with the handle in the open position.
Figure 44:
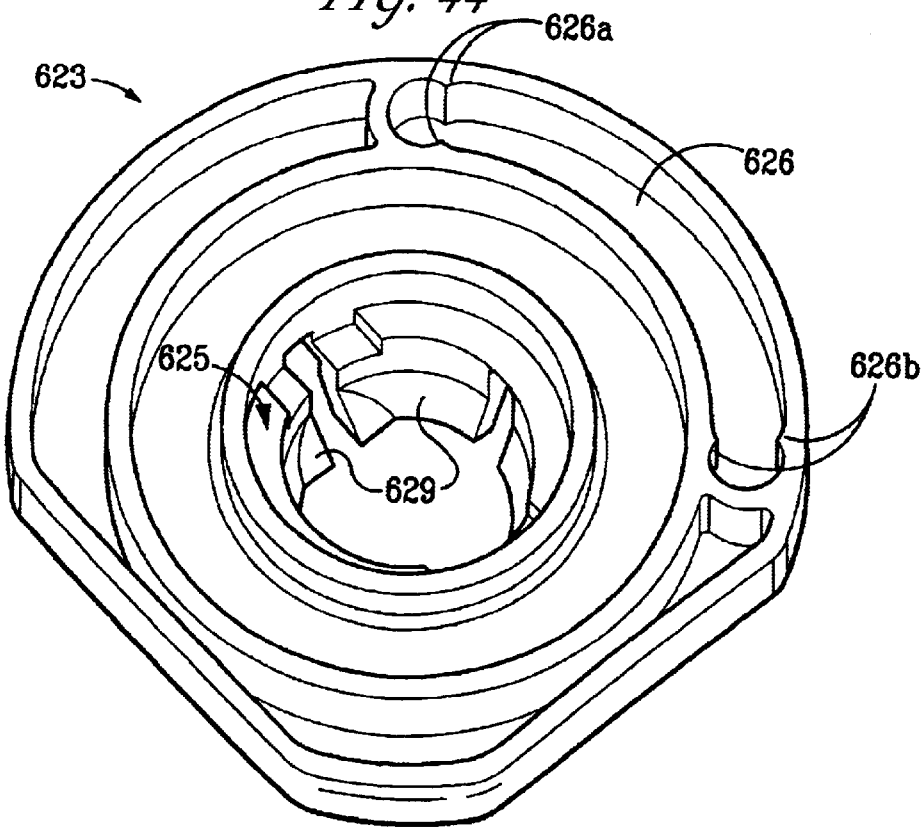
FIG. 44 is a top parallel perspective view of the retaining member of the embodiment of the latch shown in FIG. 37.

Referring to FIG. 38, locking means is also provided to lock the latch 610 against unauthorized opening. The locking means is shown comprising a lockplug 615 which has a key slot 616 therein. The locking means further includes retaining means for retaining the lockplug 615 on the housing 611. The retaining means is shown in FIG. 44 comprising a retaining member 623 which is configured for disposition on a connecting end 627 (FIGS. 39 and 40) of the lockplug 615 located on the lockplug end opposite of the key slot 616 end. FIG. 39 shows the retaining member 623 installed on the lock plug end 627.

The retaining member 623 has a retaining portion 625 with a plurality of connecting flanges thereon 629 which, as shown in FIG. 39, clamp over the lock plug end 627. A radial slot portion 626 is disposed on one side of the retaining member 623 as shown in FIG. 44. The radial slot portion 626 has a pair of protrusions 626*a*, 626*b* provided at each opposite end of the slot arc, with each pair being disposed so that one member of each pair 626*a* is located on one side of the slot 626 to face the other member of the pair 626*a* located on the other side of the slot 626. The protrusions 626*a* and 626*b* define a convergence of the slot 626 at each end thereof to provide a discrete retention position for accommodating a cam pin member 639 (FIG. 42) at each opposite slot end.

Preferably, the retaining member 623 includes connecting means for connecting it to the connecting end 627 of the lockplug 615 to secure it thereto for corresponding rotational movement with the lockplug 615, i.e., when the lockplug key (not shown) is rotated in the key slot 616. The retaining member connecting means is shown comprising a plurality of flanges 629 provided on opposite sides of the radial slot portion 626. The lockplug 615, preferably, is configured for snap-fit installation of the retaining member 623 onto its connecting end 627 by first positioning the retaining portion 625 over the lockplug connecting end 627, and then sliding the retaining member 623 over the connecting end 627 of the lockplug 615.

As shown best in FIG. 42, the cam pin member 639 is provided on the housing 611 to facilitate holding the retaining member 623. The radial slot 626 is moved along the cam pin member 639 during the rotation of the lockplug 615 when opening and closing the locking means.

Figure 40:
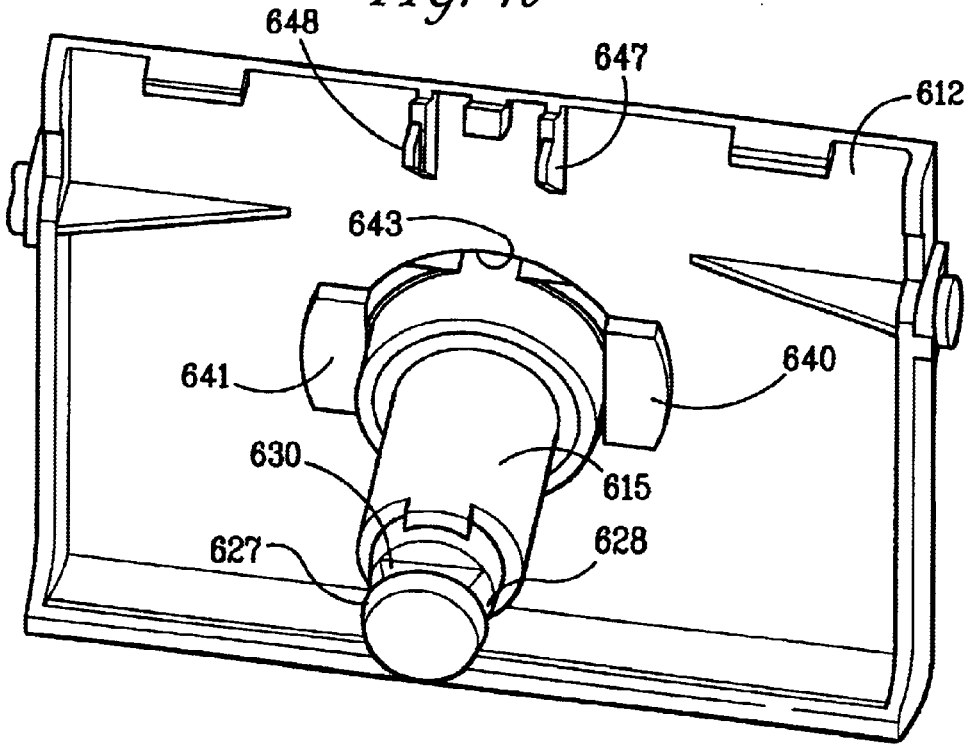
FIG. 40 is a rear parallel perspective view of the handle and lock plug of the embodiment of the latch shown in FIG. 37, shown with the lock plug detached from the housing.

As best shown in FIGS. 40 and 45, the lockplug 615 preferably has a groove 628 disposed at the connecting end 627. The groove 628 is keyed for corresponding connection with the retaining member 623. This permits the retaining member 623 to snap onto the connecting end 627. The key configuration comprises notches 630, 631 which maintains the retaining member 623 on the connecting end 627 of the lock plug 615 to permit rotation of the lockplug 615 and retaining member 623 as a unit (when the locking means is operated to release and secure the handle 612).

Figure 43:
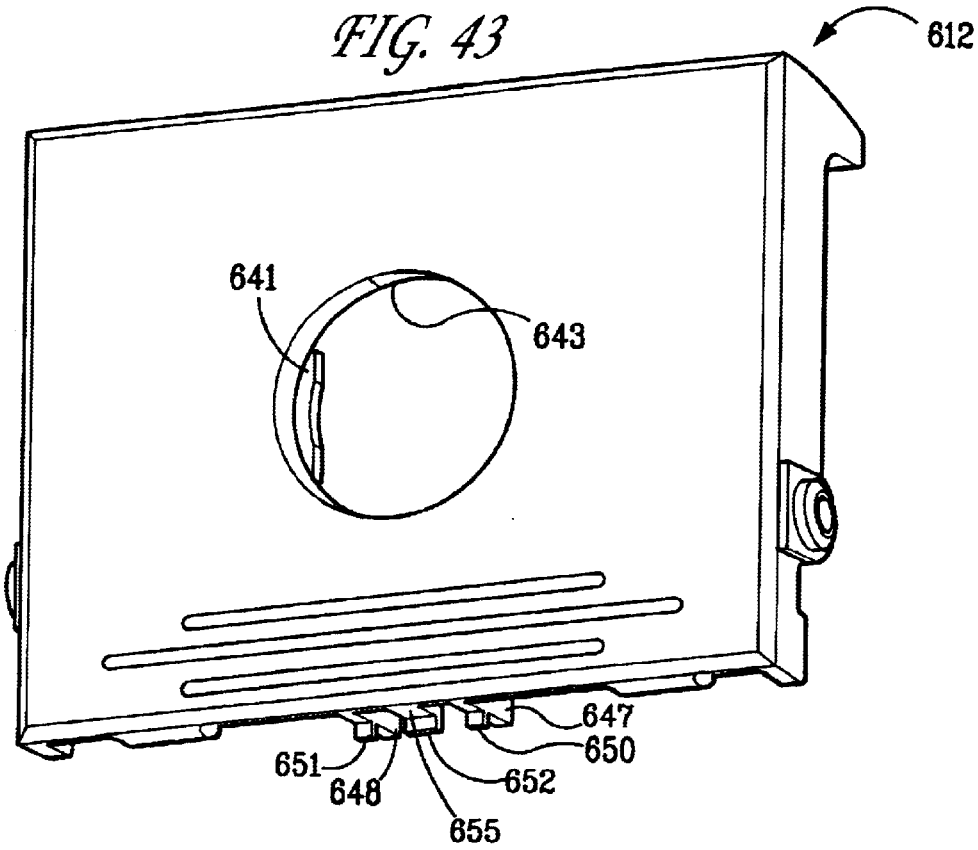
FIG. 43 is a top perspective view of the handle of the embodiment of the latch shown in FIG. 37.

The lockplug 615 has a collar 635 disposed at the end opposite the connecting end 267. The collar 635 has engaging means comprising a pair of outwardly extending radial flanges 636,637 which are spaced apart. Referring to FIGS. 38, 40 and 43, the handle 612 is shown with a pair o flocking legs or keeper elements 640, 641 disposed on the rear surface on opposite circumferential sides of the lockplug aperture 643. The radial flanges 636,637 are shown in FIG. 40 positioned over the keeper elements 640,641 to lock the handle 612 and prevent lifting of the handle 612 relative to the housing 611. This secures the pawl 613 against release from a keeper (not shown).

The pawl 613 preferably comprises a spring member, as described above in connection with the pawl 413 of the latch embodiment 410. As shown in FIG. 43, fingers 647,648 are provided on the handle 612 for engaging the pawl 613 and rotating it to release the pawl 613 from a keeper (not shown). The pawl 613 preferably has slots (not shown) which are disposed therein, similar to those slots 444,445 of the pawl 413 of the latch embodiment 410 described above.

The latch 610 further has latching facilitating means for increasing the engaging force between the pawl 613 and a keeper (not shown). The latching facilitating means further provides means for securing the latch 610 against unauthorized use,stampering, and forcing, thereby providing enhanced latching capability. The latching facilitating means is shown comprising a plurality of projecting elements 650, 651 and 652 provided on the handle 612 in the vicinity of the fingers 647,648. First and second projecting elements 650, 651 are disposed on each respective finger 647, 648 and protrude forward in relation to the housing 611. A third projecting element 652 is shown disposed between the fingers 647,648 on a leg 655 extending from the top of the handle 612. The projecting elements 650,651,652 engage the pawl 613 when the handle 612 is closed, to urge the pawl 613 into its secured position, against a keeper (not shown).

Preferably, the housing includes flange members 677, 678 disposed on each side of the pawl member 613 and extending parallel, to the length of the pawl member 613. The flange members 677, 678 are provided to facilitate clearance of the latch 610 with a keeper member or surface.

Figure 41:
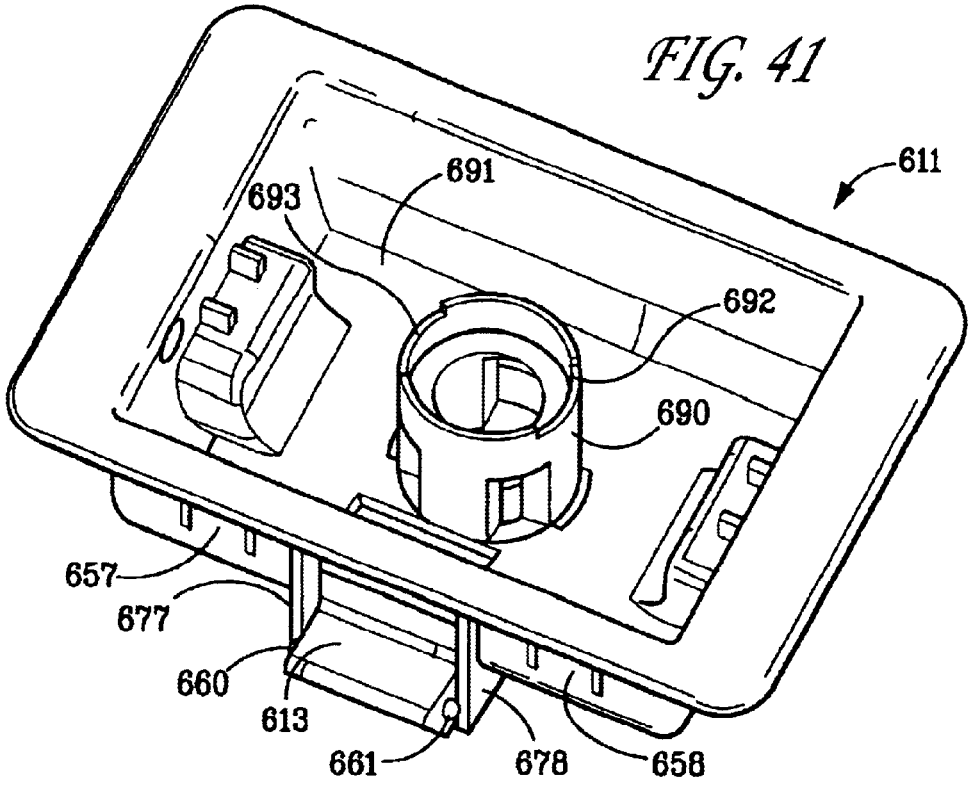
FIG. 41 is a front parallel perspective view of the housing of the embodiment of the latch of FIG. 37.

Reference being made to FIGS. 39, 41, and 42, where the pawl 613 is provided with resistive means comprising bosses 660,661 disposed on opposite lateral sides thereof. The bosses 660,661 engage the flange members 677,678 of the housing 611, respectively, when the pawl 613 is retracted with the handle 612. This provides resistance to prevent excessive play in the pawl 613 when in a latched position or when the pawl 613 is being retracted or closed.

As shown in FIGS. 28 and 41, the housing 611 is provided with a lockplug sleeve 690 which extends upwardly from the floor 691 of the housing 611. The sleeve 690 has a generally cylindrical configuration with a pair of notches 692, 693 disposed along the upper peripheral edge thereof. The notches 692, 693 facilitate accommodation of the keeper elements 640,641 when the handle 612 is closed. The locking means of the latch embodiment 610 is operated by using a key to rotate the lockplug flanges 636,637 into or out from engagement with the respective corresponding keepers 640,641 provided on the handle 612.

The latch 610 operates in the same manner as the latch 410 described above, but with the additional features described herein. It will be further understood that one or more of the features disclosed herein in connection with the embodiment of the latch 610 can also be utilized with the latch embodiment 410 consistent with the present invention.

FIG. 46 shows yet another embodiment of a latch 710 according to the present invention, similar to the embodiment 610 shown and described above, but without a lockplug. Referring to FIG. 46, it will be understood that the embodiment 610 can be provided for use without the lockplug 215 to function similar to the handle 512 described above, but including the latching facilitating means of the latch embodiment 610 shown and described above.

One or more of the features described herein in connection with a latch embodiment disclosed herein, can be employed with another latch embodiment consistent with the principles of the applicant's present invention. Other modifications to the above description can be made consistent with the spirit and scope of the invention disclosed herein. For example, while the keeper is referred to as a separate member, it will be understood that the keeper can comprise a panel, enclosure frame or other surface which the pawl can engage, consistent with the disclosure provided herein. Also, while the present invention is described in connection with a lockplug, it is also understood that a knob, handle or other member can be used to rotate a member into and out of the way of the handle locking legs 471,472 or keeper elements 640,641 to regulate the opening and closing.

These and other advantages of the present invention can be made consistent with the spirit and scope of the invention as disclosed in the Summary of the Invention, the Brief Description of the Drawing Figures, the Detailed Description of the Preferred Embodiments and, the appended claims. While the above description constitutes preferred embodiments of the present invention, it will be appreciated that the invention is subject to modification, variation and change, without departing from the proper scope or fair meaning of the present invention. In this regard, while the various features of the present invention have been shown and described in relation to a vehicle floor panel, it will be understood that many of these features are suitable in connection with latching of other members.

What is claimed is:

1. A pawl latch for securing a first member to a second member wherein a pawl of the latch is provided to engage a keeper, said latch comprising:

a) a housing which is adapted for mounting to one of said first member and said second member;

b) a pawl member connected to said housing and adapted to engage a keeper to secure the latch in a closed position, wherein said pawl member comprises a living spring member;

c) a handle pivotally connected to said housing and being movable over a pivot range including open and closed positions, said handle including actuating means for selectively engaging the pawl member when the handle is pivoted.

2. The latch of claim 1, wherein said pawl member has a foot which is disposed for engagement with said handle actuating means when said handle is pivoted.

3. The latch of claim 2, wherein said pawl member foot is provided with at least one slot therein, and wherein said actuation means comprises at least one finger, wherein said finger is moved into said slot upon pivotally moving the handle to retract said pawl by moving said pawl with said handle.

4. The latch of claim 2, further comprising locking means for locking said latch handle against movement relative to said housing.

5. The latch of claim 4, wherein said locking means comprises locking legs disposed on said handle and a locking member which has notches therein which correspond to said locking legs, said locking member being selectively rotatable between a first position wherein said notches are aligned with said locking legs to permit the handle to be movable relative to said housing and a second position, wherein said notches are not aligned with said locking legs to prevent movement of said handle relative to said housing.

6. The latch of claim 5, wherein said handle has a top surface with an aperture therein and wherein said locking legs comprise generally L-shaped members disposed on opposite sides of said aperture.

7. The latch of claim 1, wherein said housing comprises a seat on each side thereof for supporting said handle.

8. The latch of claim 7, wherein said handle has a top surface and a flange disposed on each side of said top surface extending downwardly therefrom, wherein each said flange engages said housing seat to position said handle relative to said housing.

9. The latch of claim 1, wherein said housing has stop means for holding the handle in a partially raised position.

10. The latch of claim 1, wherein said housing has stop means for securing the handle in a position relative to said housing.

11. The latch of claim 10, wherein said stop means comprises at least one leg member connected to the housing at one end thereof and having a free end with an engaging element thereon, and wherein said handle has at least one limiting element which is disposed on said handle to engage said engaging element of said at least one leg member when said handle is moved to said closed position of said handle.

12. The latch of claim 9, wherein said stop means comprises at least one leg member connected to the housing at one end thereof and having a free end with an engaging element therein, and wherein said handle has at least one limiting element which is disposed on said handle to engage said engaging element of said at least one leg member when said handle is pivoted.

13. The latch of claim 12, wherein said at least one limiting element comprises a tab portion extending downwardly from said handle surface.

14. The latch of claim 12, wherein said at least one leg member is a flexible member.

15. The latch of claim 12, wherein said at least one leg member comprises a spring member.

16. The latch of claim 4 wherein said locking means comprises a lockplug and a retaining member which connects said lockplug to said housing.

17. The latch of claim 1, wherein said housing has protruding flanges disposed vertically on each side of said pawl.

18. The latch of claim 1, further comprising latching facilitating means for increasing the engaging force between said pawl member and a keeper.

19. The latch of claim 18, wherein said pivot range includes at least one position over said range wherein said handle is closed, and wherein said latching facilitating means comprises a plurality of projecting elements provided on said handle to engage said pawl member and direct said pawl member toward said keeper when said handle is closed.

20. The latch of claim 1, wherein said housing has a pair of spaced apart flanges defining a space therebetween, and wherein said pawl member is disposed between said spaced apart flanges, said pawl member being pivotally movable when engaged with said handle, said pawl member having resistive means for imparting resistance to the pawl member relative to the housing when the pawl member is pivotally moved.

21. The latch of claim 20, wherein said resistive means comprises a boss disposed on each opposite lateral side of said pawl member for engagement with an adjacent housing flange.

22. The latch of claim 1, further comprising locking means for locking said handle against movement relative to said housing, wherein said housing further comprises a sleeve, and wherein said locking means comprises a lockplug carried in said sleeve.

23. The latch of claim 1, further comprising locking means for locking said handle against movement relative to said housing, wherein said locking means comprises a lockplug carried on said housing and mounted thereto with retaining means, wherein said handle has handle keeper means disposed on said handle, and wherein said lockplug has engaging means for selective positioning relative to said handle keeper means to secure and release said handle relative to said housing.

24. The pawl latch of claim 1, wherein said pawl member has slots disposed therein, and wherein said actuating means comprises fingers which are disposed for insertion into said slots to facilitate pivoting of said pawl member with said handle when said handle is pivoted.

25. A pawl latch for securing a first member to a second member, wherein the latch engages with a keeper, said latch comprising:

a) a housing, including a pawl member connected thereto and being movable in relation to said housing;

b) a handle pivotally connected to said housing and being pivotally movable over a pivot range, said handle including actuating means for engaging the pawl member;

c) wherein said pawl member comprises a living spring member and includes a leg portion which is disposed for engagement with said handle actuating means upon rotation of said handle;

d) wherein said pawl member is joined with said housing along an edge of the pawl member.

26. The latch of claim 25, wherein said pawl member leg portion is provided with at least one slot, and wherein said actuation means comprises at least one finger, wherein said finger is moved into said slot upon pivotally moving the handle to retract said pawl.

27. The latch of claim 25, further comprising locking means; wherein said handle has a top surface with an aperture therein; wherein said locking means includes locking legs disposed on said handle on opposite sides of said aperture, and a locking member which has notches therein which correspond to said locking legs, said locking member being selectively rotatable between a first position wherein said notches are aligned with said locking legs to permit the handle to be movable relative to said housing and a second position, wherein said notches are not aligned with said locking legs to prevent movement of said handle relative to said housing.

28. A pawl latch for securing a first member to a second member wherein a pawl of the latch is provided to engage a keeper, said latch comprising:

a) a housing which is adapted for mounting to one of said first member and said second member, b) a pawl member connected to said housing and adapted to engage a keeper to secure the latch in a closed position, wherein said pawl member comprises a living spring and has a leg extending from the housing at a top end thereof and an engaging element at the bottom leg end thereof, said top leg end being connected to said housing along an edge thereof to form a pivot axis about which said pawl member pivots, and wherein said living spring biases said pawl member engaging element away from said housing;

c) a handle pivotally connected to said housing and being movable over a pivot range, said handle including actuating means for selectively engaging the pawl member when the handle is pivoted.

29. A latch for securing a first member to a second member, said latch comprising:

a) a housing which is adapted for mounting to the first member;

b) a pawl member slidably supported by said housing, said pawl member being movable between extended and retracted positions, and said pawl member being adapted to secure the first member relative to the second member when said pawl member is in said extended position and the first member is in a closed position relative to the second member;

c) a handle pivotally supported by said housing and being movable over a pivot range including open and closed positions; and d) an actuator positioned such that said handle engages said actuator as said handle moves from said closed position to said open position, said actuator at least engaging said pawl member so as to move said pawl member from said extended position toward said retracted position in response to pivotal movement of said handle toward said open position, said actuator being supported for linear movement relative to said housing such that said actuator moves linearly rearward relative to said housing in a direction parallel to a direction of movement of said pawl member as said pawl member moves toward said retracted position, in response to said handle pivotally moving toward said open position.

30. The latch of claim 29, further comprising biasing means for biasing said pawl toward said extended position.

31. The latch of claim 29, wherein said pawl member is provided with at least one slot therein, wherein said actuator has at least one leg that extends into said slot in said pawl member, and wherein said leg engages a rearward end of said slot in said pawl member upon pivotally moving said handle to retract said pawl.

32. The latch of claim 29, wherein said housing comprises a seat on each side thereof for supporting said handle in said closed position.

33. The latch of claim 32, wherein said handle has a top surface and a flange disposed on each side of said top surface extending downwardly therefrom, wherein each said flange engages said housing seat to position said handle relative to said housing.

34. The latch of claim 29, wherein said housing has detents for holding the handle in a partially raised position.

35. The latch of claim 29, further comprising:

a lock plug supported by said housing for selective rotation between locked and unlocked positions; and a locking pawl arm attached to said lock plug so as to move rotationally with said lock plug between locked and unlocked positions, said locking pawl arm engaging the second member or a keeper fixedly located relative to the second member when said lock plug is in said locked position such that the first member remains secured in a closed position relative to the second member.

36. The latch of claim 35, wherein said locking pawl arm is resilient such that the first member can be moved to the closed position relative to the second member even with said lock plug in said locked position.

37. The latch of claim 35, further comprising biasing means for biasing said pawl toward said extended position.

38. The latch of claim 35, wherein said pawl member is provided with at least one slot therein, wherein said actuator has at least one leg that extends into said slot in said pawl member, and wherein said leg engages a rearward end of said slot in said pawl member upon pivotally moving said handle to retract said pawl.

39. The latch of claim 38, wherein said pawl member has a plurality of slots, wherein said actuator includes a base, a plurality of contact ribs extending upward from said base, and a plurality of legs which extend down ward from said base and into said plurality of slots provided in said pawl member, and wherein said plurality of contact ribs are engaged by said handle during movement of said handle toward said open position.

40. The latch of claim 39, wherein said plurality of contact ribs are angled to maximize contact with said handle during movement of said handle toward said open position.

41. The latch of claim 35, wherein said housing comprises a seat on each side thereof for supporting said handle in said closed position.

42. The latch of claim 41, wherein said handle has a top surface and a flange disposed on each side of said top surface extending downwardly therefrom, wherein each said flange engages said housing seat to position said handle relative to said housing.

43. The latch of claim 35, wherein said housing has detents for holding the handle in a partially raised position.

44. The latch of claim 29, wherein said pawl member is provided with at least one slot therein, wherein said actuator has at least one snap leg having a tapered flange portion, said at least one snap leg extending into said slot in said pawl member to thereby connect said actuator and said pawl member.

45. A latch for securing a first member to a second member, said latch comprising:

a) a housing which is adapted for mounting to the first member;

b) a pawl member slidably supported by said housing, said pawl member being movable between extended and retracted positions, and said pawl member being adapted to secure the first member relative to the second member when said pawl member is in said extended position and the first member is in a closed position relative to the second member;

c) a handle pivotally supported by said housing and being movable over a pivot range including open and closed positions; and d) an actuator for selectively engaging said pawl member and at least moving said pawl member from said extended position toward said retracted position in response to pivotal movement of said handle from said closed position toward said open position, said actuator being slidably supported by said housing such that said actuator moves rearward relative to said housing in response to said handle moving toward said open position, wherein said pawl member has a plurality of slots, wherein said actuator includes a base, a plurality of contact ribs extending upward from said base, and a plurality of legs which extend down ward from said base and into said plurality of slots provided in said pawl member, wherein at least one of said plurality of legs engages a rearward end of a respective one of said plurality of slots in said pawl member upon pivotally moving said handle to retract said pawl, and wherein said plurality of contact ribs are engaged by said handle during movement of said handle toward said open position.

46. The latch of claim 45, wherein said plurality of contact ribs are angled to maximize contact with said handle during movement of said handle toward said open position.

47. A latch for securing a first member to a second member, said latch comprising:

a) a housing which is adapted for mounting to the first member;

b) a pawl member slidably supported by said housing, said pawl member being movable between extended and retracted positions and said pawl member being adapted to secure the first member relative to the second member when said pawl member is in said extended position and the first member is in a closed position relative to the second member;

c) a handle pivotally supported by said housing and being movable over a pivot range including open and closed positions;

d) an actuator for selectively engaging said pawl member and at least moving said pawl member from said extended position toward said retracted position in response to pivotal movement of said handle from said closed position toward said open position, said actuator being slidably supported by said housing such that said actuator moves rearward relative to said housing in response to said handle moving toward said open position;

a lock plug supported by said housing for selective rotation between locked and unlocked positions; and a retaining member attached to said lock plug so as to move rotationally with said lock plug between locked and unlocked positions, said retaining member having an arm that interferes with rearward movement of said actuator when said lock plug is in said locked position such that movement of said pawl to said retracted position by actuation of said handle is prevented.

48. The latch of claim 47, further comprising biasing means for biasing said pawl toward said extended position.

49. The latch of claim 47, wherein said pawl member is provided with at least one slot therein, wherein said actuator has at least one leg that extends into said slot in said pawl member, and wherein said leg engages a rearward end of said slot in said pawl member upon pivotally, moving said handle to retract said pawl.

50. The latch of claim 49, wherein said pawl member has a plurality of slots, wherein said actuator includes a base, a plurality of contact ribs extending upward from said base, and a plurality of legs which extend down ward from said base and into said plurality of slots provided in said pawl member, and wherein said plurality of contact ribs are engaged by said handle during movement of said handle toward said open position.

51. The latch of claim 50, wherein said plurality of contact ribs are angled to maximize contact with said handle during movement of said handle toward said open position.

52. The latch of claim 47, wherein said housing comprises a seat on each side thereof for supporting said handle in said closed position.

53. The latch of claim 52, wherein said handle has a top surface and a flange disposed on each side of said top surface extending downwardly therefrom, wherein each said flange engages said housing seat to position said handle relative to said housing.

54. The latch of claim 47, wherein said housing has detents for holding the handle in a partially raised position.

55. A latch for securing a first member to a second member, said latch comprising:

a) a housing which is adapted for mounting to the first member;

b) a pawl member supported by said housing, said pawl member movable between extended and retracted positions, and said pawl member being adapted to secure the first member relative to the second member when said pawl member is in said extended position and the first member is in a closed position relative to the second member;

c) a handle pivotally supported by said housing and being movable over a pivot range including open and closed positions;

d) a lock plug supported by said housing for selective rotation between locked and unlocked positions; and e) a retaining member attached to said lock plug so as to retain said lock plug in said housing, wherein said retaining member moves rotationally with said lock plug between locked and unlocked positions.

56. The latch of claim 55, wherein said housing has a pin and said retaining member has a slot engaged by said pin to thereby guide rotational movement of said retaining member.

* * * * *